US010779107B2

(12) United States Patent
Fujii et al.

(10) Patent No.: US 10,779,107 B2
(45) Date of Patent: Sep. 15, 2020

(54) OUT-OF-HEAD LOCALIZATION DEVICE, OUT-OF-HEAD LOCALIZATION METHOD, AND OUT-OF-HEAD LOCALIZATION PROGRAM

(71) Applicant: JVCKENWOOD Corporation, Yokohama-shi, Kanagawa (JP)

(72) Inventors: Yumi Fujii, Yokohama (JP); Hisako Murata, Yokohama (JP); Takahiro Gejo, Yokohama (JP)

(73) Assignee: JVCKENWOOD CORPORATION, Yokohama-Shi, Kanagawa (JP)

( * ) Notice: Subject to any disclaimer, the term of this patent is extended or adjusted under 35 U.S.C. 154(b) by 0 days.

(21) Appl. No.: 16/545,909

(22) Filed: Aug. 20, 2019

(65) Prior Publication Data

US 2019/0373400 A1 Dec. 5, 2019

Related U.S. Application Data

(63) Continuation of application No. PCT/JP2018/000382, filed on Jan. 10, 2018.

(30) Foreign Application Priority Data

Feb. 20, 2017 (JP) ..... 2017-029296

(51) Int. Cl.
*H04S 7/00* (2006.01)
*H04R 5/04* (2006.01)
(Continued)

(52) U.S. Cl.
CPC ..... *H04S 7/307* (2013.01); *H04R 3/04* (2013.01); *H04R 5/033* (2013.01); *H04R 5/04* (2013.01); *H04S 2420/01* (2013.01)

(58) Field of Classification Search
CPC ..... H04S 7/307; H04S 2420/01; H04R 3/04; H04R 5/033; H04R 5/04
See application file for complete search history.

(56) References Cited

U.S. PATENT DOCUMENTS 6,240,189 B1 * 5/2001 Aylward ..... H04S 3/00 348/480
2006/0009225 A1 1/2006 Herre et al.
(Continued)

FOREIGN PATENT DOCUMENTS

EP 0762803 A1 3/1997
JP H5-252598 A 9/1993
(Continued)

OTHER PUBLICATIONS

English machine translation of JP 2017-028526 (Murata et al., Out-Of-Head Localization Processing Device, Out-Of-Head Localization Processing Method and Program, published Feb. 2017) (Year: 2017).*
(Continued)

*Primary Examiner* — Mark Fischer
(74) *Attorney, Agent, or Firm* — Procopio, Cory, Hargreaves & Savitch LLP

(57) ABSTRACT

An out-of-head localization device according to this embodiment includes an adder that calculates a common-mode signal of stereo reproduced signals, a ratio setting unit that sets a subtraction ratio for subtracting the common-mode signal, a subtraction unit that subtracts the common-mode signal from the stereo reproduced signals at the subtraction ratio and thereby generates corrected signals, a convolution calculation unit that performs convolution on the corrected signals by using spatial acoustic transfer characteristics and thereby generates a convolution calculation signal, a filter unit that performs filtering on the con-
(Continued)

volution calculation signal by using a filter and thereby generates an output signal, and headphones that output the output signal to a user.

9 Claims, 18 Drawing Sheets

(51) Int. Cl.
*H04R 5/033* (2006.01)
*H04R 3/04* (2006.01)

(56) References Cited

U.S. PATENT DOCUMENTS

| | | | | |
|---|---|---|---|---|
| 2007/0110249 | A1 | 5/2007 | Kimura et al. | |
| 2015/0125010 | A1* | 5/2015 | Yang | H04S 1/00 381/300 |

FOREIGN PATENT DOCUMENTS

| | | | |
|---|---|---|---|
| JP | H7-123498 | A | 5/1995 |
| JP | 2017-028526 | A | 2/2017 |
| WO | 2004/049759 | A1 | 6/2004 |
| WO | 2005/062672 | A1 | 7/2005 |
| WO | 2013/181172 | A1 | 12/2013 |

OTHER PUBLICATIONS

English machine translation of JPH07-123498 (Fujinami et al., Headphone Reproducing System, published May 1995) (Year: 1995).*

International Preliminary Report on Patentability for PCT/JP2018/000382 dated Aug. 2019 (Year: 2019).*

* cited by examiner

OUT-OF-HEAD LOCALIZATION DEVICE, OUT-OF-HEAD LOCALIZATION METHOD, AND OUT-OF-HEAD LOCALIZATION PROGRAM

CROSS REFERENCE TO RELATED APPLICATION

This application is a U.S. National Stage entry of PCT Application No: PCT/JP2018/000382, filed on Jan. 10, 2018, which is based upon and claims the benefit of priority from Japanese patent application No. 2017-29296, filed on Feb. 20, 2017, the disclosure of which is incorporated herein in its entirety by reference.

BACKGROUND

The present invention relates to an out-of-head localization device, an out-of-head localization method, and an out-of-head localization program.

Sound localization techniques include an out-of-head localization technique, which localizes sound images outside the head of a listener by using binaural headphones (Patent Literature 1: Japanese Unexamined Patent Application Publication No. H5-252598). Patent Literature 1 uses a sound localization filter generated from a result of convolving an inverse headphone response and a spatial response. The spatial response is obtained by measurement of spatial transfer characteristics from a sound source (speaker) to the ears (head-related transfer function HRTF). The inverse headphone response is an inverse filter that cancels out characteristics from headphones to the ears or eardrums (ear canal transfer function ECTF).

SUMMARY

Further, for a person with normal hearing, the volume of sounds (loudness) is higher when heard by two ears than when heard by only one ear. This is called "binaural effect". By the binaural effect, binaural loudness summation amounts to 5 to 6 [dB], or even amounts to 10 [dB] in some reports (Non Patent Literature 1: "Hearing Aids", Harvey Dillon, Ishiyaku Publishers, Inc.).

Note that, in the case where sounds are output from two speakers such as stereo reproduction, the loudness summation can be regarded as being exactly the same as a monaural phenomenon both when the sounds are heard as two real sound sources due to delay of one sound or the like and when they are heard as a virtual sound image synthesized from sounds from two sound sources (Non Patent Literature 2: "Auditory Sense and Psychoacoustics", Corona Publishing Co., Ltd. and The Acoustical Society of Japan).

The binaural effect occurs for sound images of an out-of-head localization listening device in the form of headphones or earphones, not to mention virtual sound images synthesized from two speakers placed left and right. Particularly, sounds from headphones are heard louder than sounds from speakers because the distance from a reproduction unit to the ears is shorter. Further, the present inventors conducted testing that compares the loudness when a sound pressure level applied to the ear is constant among phantom center sound images generated by stereo speakers, phantom center sound images generated by stereo headphones, and phantom sound images of out-of-head localization headphones. As a result, it was found that the volume of the phantom sound images created by the stereo headphones and the out-of-head localization headphones is louder than the volume of the phantom sound image created by the stereo speakers. Thus, sounds are heard louder when reproduced by headphones than by speakers, and the binaural effect is more significant.

Therefore, phantom sound images created by the out-of-head localization headphones are more emphasized than simulated speaker sound fields by the binaural effect when reproduced by the headphones. To be specific, one problem is that the localization of sound images localized in the phantom center such as vocals feels nearby. Another problem is that increasing the reproduced volume of the speakers and the headphones results in the reversal of the volume of the phantom sound images created by the stereo headphones and the out-of-head localization headphones and the volume of the phantom sound image created by the stereo speakers upon exceeding a certain volume, and the volume of the sound images localized at the phantom center such as vocals is heard louder when reproduced by the stereo headphones and the out-of-head localization headphones.

The present embodiment has been accomplished to solve the above problems and an object of the present invention is thus to provide an out-of-head localization device, an out-of-head localization method, and an out-of-head localization program capable of performing appropriate out-of-head localization.

An out-of-head localization device according to an embodiment includes a common-mode signal calculation unit configured to calculate a common-mode signal of stereo reproduced signals, a ratio setting unit configured to set a subtraction ratio for subtracting the common-mode signal, a subtraction unit configured to subtract the common-mode signal from the stereo reproduced signals at the subtraction ratio and thereby generate corrected signals, a convolution calculation unit configured to perform convolution on the corrected signals by using spatial acoustic transfer characteristics and thereby generate a convolution calculation signal, a filter unit configured to perform filtering on the convolution calculation signal by using a filter and thereby generate an output signal, and an output unit configured to include headphones or earphones and output the output signal to a user.

An out-of-head localization method according to an embodiment includes a step of calculating a common-mode signal of stereo reproduced signals, a step of setting a subtraction ratio for subtracting the common-mode signal, a step of subtracting the common-mode signal from the stereo reproduced signals at the subtraction ratio and thereby generating corrected signals, a step of performing convolution on the corrected signals by using spatial acoustic transfer characteristics and thereby generating a convolution calculation signal, a step of performing filtering on the convolution calculation signal by using a filter and thereby generating an output signal, and a step of outputting the output signal to a user through headphones or earphones.

An out-of-head localization program according to an embodiment causes a computer to execute a step of calculating a common-mode signal of stereo reproduced signals, a step of setting a subtraction ratio for subtracting the common-mode signal, a step of subtracting the common-mode signal from the stereo reproduced signals at the subtraction ratio and thereby generating corrected signals, a step of performing convolution on the corrected signals by using spatial acoustic transfer characteristics and thereby generating a convolution calculation signal, a step of performing filtering on the convolution calculation signal by using a filter and thereby generating an output signal, and a step of outputting the output signal to a user through headphones or earphones.

DETAILED DESCRIPTION

The overview of an out-of-head localization process according to this embodiment is described hereinafter. The out-of-head localization process according to this embodiment performs out-of-head localization by using personal spatial acoustic transfer characteristics (which are also called a spatial acoustic transfer function) and ear canal transfer characteristics (which are also called an ear canal transfer function). In this embodiment, out-of-head localization is achieved by using the spatial acoustic transfer characteristics from speakers to a listener's ears and inverse characteristics of the ear canal transfer characteristics when headphones are worn.

In this embodiment, the ear canal transfer characteristics, which are characteristics from a headphone speaker unit to the entrance of the ear canal when headphones are worn are used. By carrying out convolution with use of the inverse characteristics of the ear canal transfer characteristics (which are also called an ear canal correction function), it is possible to cancel out the ear canal transfer characteristics.

An out-of-head localization device according to this embodiment includes an information processor such as a personal computer, a smart phone or a tablet PC, and it includes a processing means such as a processor, a storage means such as a memory or a hard disk, a display means such as a liquid crystal monitor, an input means such as a touch panel, a button, a keyboard and a mouse, and an output means with headphones or earphones. The following embodiment is described based on the assumption that the out-of-head localization device is a smartphone. To be specific, a processor of the smartphone executes an application program (application) for performing out-of-head localization, and thereby out-of-head localization is performed. Such an application program can be obtained through a network such as the Internet.

First Embodiment

Structure of Out-of-Head Localization Device

Figure 1:
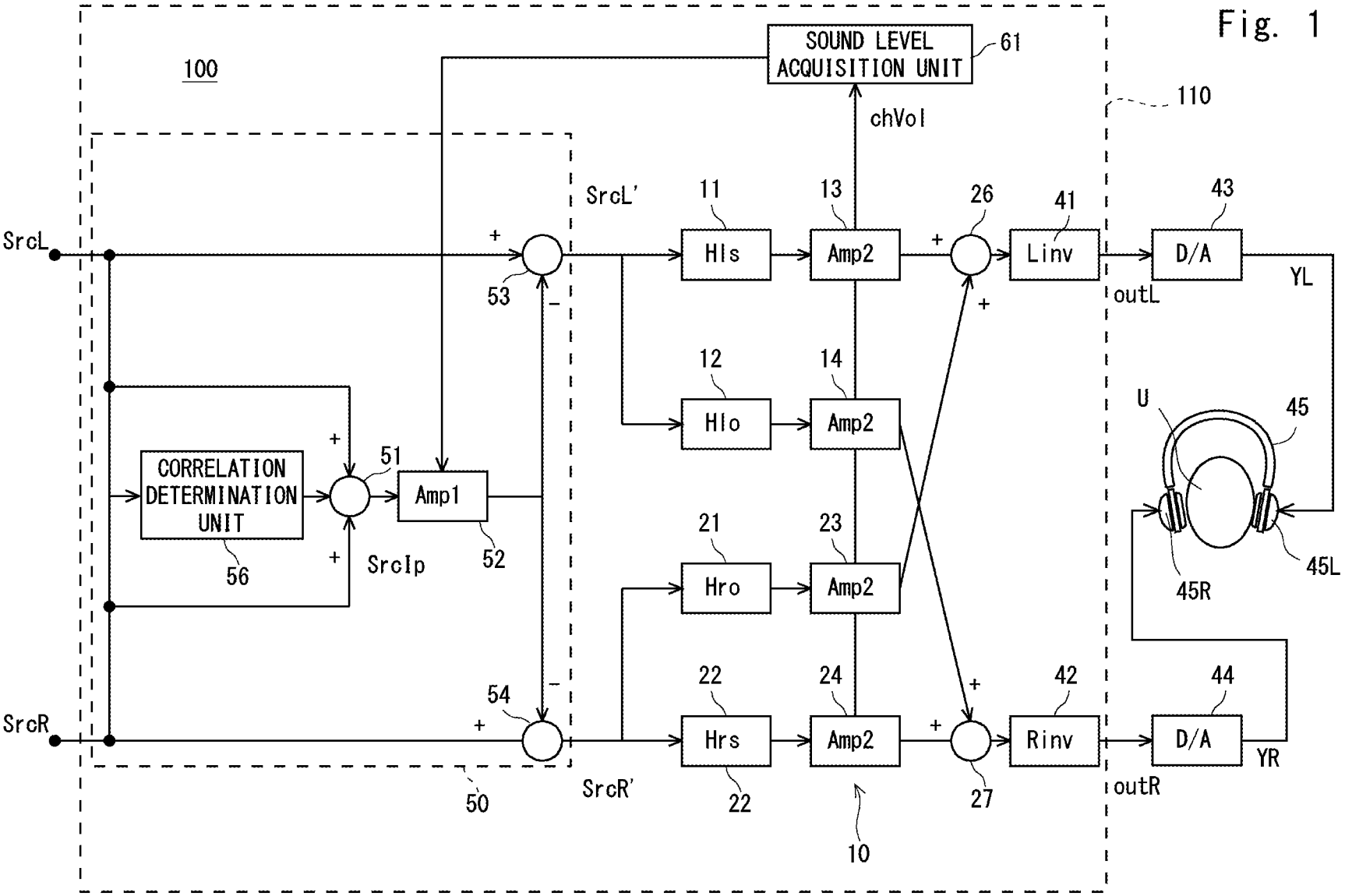
FIG. 1 is a block diagram showing an out-of-head localization device according to an embodiment.

FIG. 1 shows an out-of-head localization device 100 according to this embodiment. FIG. 1 is a block diagram of the out-of-head localization device 100. The out-of-head localization device 100 reproduces sound fields for a user U who is wearing headphones 45. Thus, the out-of-head localization device 100 performs out-of-head localization for L-ch and R-ch stereo input signals SrcL and SrcR. The L-ch and R-ch stereo input signals SrcL and SrcR are analog audio reproduced signals that are output from a CD (Compact Disc) player or the like or digital audio data such as mp3 (MPEG Audio Layer-3). Note that the out-of-head localization device 100 is not limited to a physically single device, and a part of processing may be performed in a different device. For example, a part of processing may be performed by a personal computer, a smartphone or the like, and the rest of processing may be performed by a DSP (Digital Signal Processor) included in the headphones 45 or the like.

The out-of-head localization device 100 includes an arithmetic processing unit 110 and headphones 45. The arithmetic processing unit 110 includes a correction unit 50, an out-of-head localization unit 10, filter units 41 and 42, D/A (Digital to Analog) converters 43 and 44, and a volume acquisition unit 61.

The arithmetic processing unit 110 performs processing in the correction unit 50, the out-of-head localization unit 10, the filter units 41 and 42, and the volume acquisition unit 61 by running a program stored in a memory. The arithmetic processing unit 110 is a smartphone or the like, and executes an application for out-of-head localization processing. The D/A converters 43 and 44 may be included in the arithmetic processing unit 110 or the headphones 45. A connection between the arithmetic processing unit 110 and the headphones 45 may be a wired connection, or a wireless connection such as Bluetooth (registered trademark).

The correction unit 50 includes an adder 51, a ratio setting unit 52, subtractors 53 and 54, and a correlation determination unit 56. The adder 51 is a common-mode signal calculation unit that calculates a common-mode signal SrcIp of stereo input signals SrcL and SrcR based on the stereo input signals SrcL and SrcR. For example, the adder 51 adds the stereo input signals SrcL and SrcR and divides it by 2 and thereby generates the common-mode signal SrcIp.

The common-mode signal is obtained by the following equation (1):

$$SrcIp=(SrcL+SrcR)/2 \quad (1)$$

Figure 2:
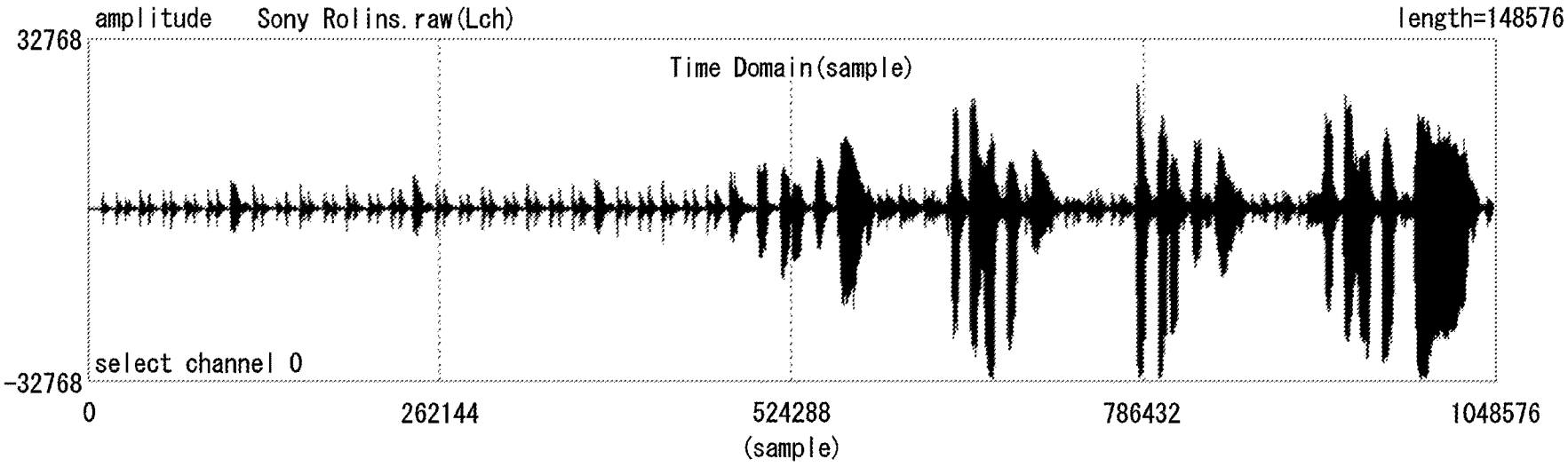
FIG. 2 is a view showing the waveform of an input signal SrcL.
Figure 3:
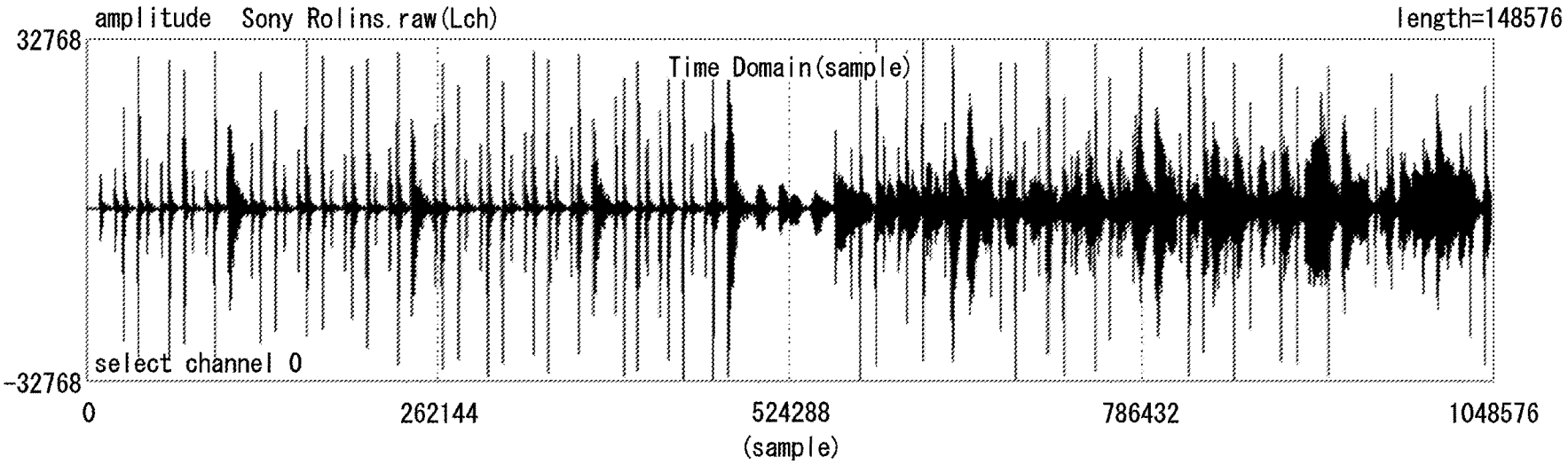
FIG. 3 is a view showing the waveform of an input signal SrcR.
Figure 4:
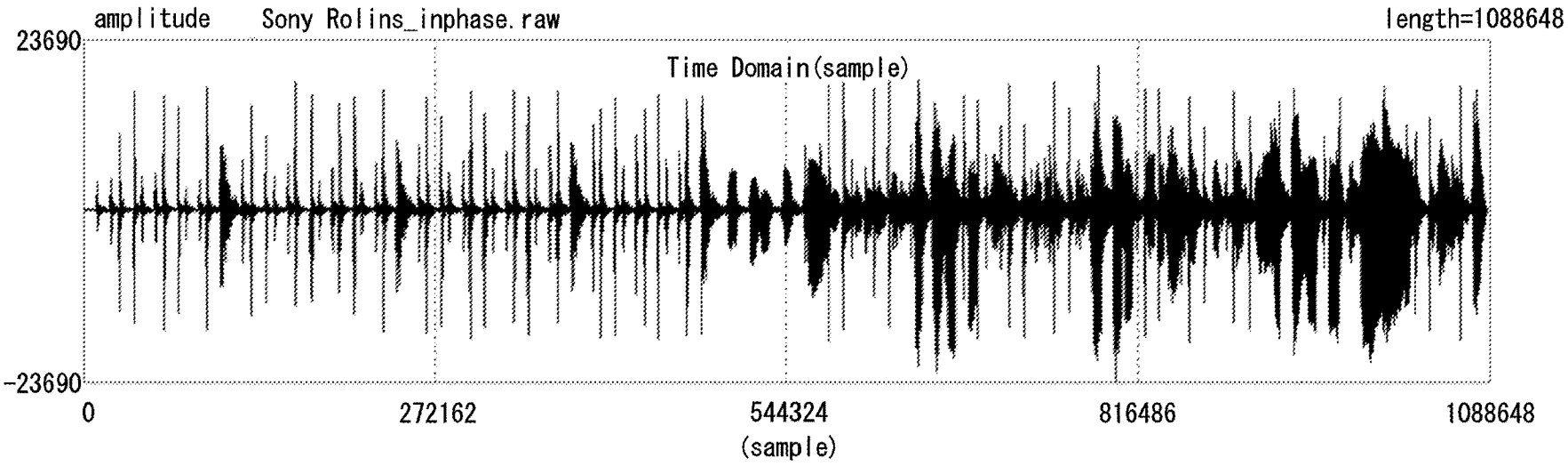
FIG. 4 is a view showing the waveform of a common-mode signal SrcIp.

FIGS. 2 to 4 show examples of the stereo input signals SrcL and SrcR and the common-mode signal SrcIp. FIG. 2 is a waveform chart showing the Lch stereo input signal SrcL, and FIG. 3 is a waveform chart showing the Rch stereo input signal SrcR. FIG. 4 is a waveform chart showing the common-mode signal SrcIp. In FIGS. 2 to 4, the horizontal axis indicates the time, and the vertical axis indicates the amplitude.

The correction unit 50 subtracts and adjusts the ratio of the common-mode signal SrcIp in the stereo input signals SrcL and SrcR based on the reproduced volume of the stereo input signals SrcL and SrcR and thereby corrects the stereo input signals SrcL and SrcR. For this correction, the ratio setting unit 52 sets a ratio for subtracting the common-mode signal SrcIp (which is referred to as a subtraction ratio Amp1). The subtractor 53 subtracts the common-mode signal SrcIp from the stereo input signal SrcL at the set subtraction ratio Amp1 and generates an Lch corrected signal SrcL'. Likewise, the subtractor 54 subtracts the common-mode signal SrcIp from the Rch stereo input signal SrcR at the set subtraction ratio Amp1 and generates an Rch corrected signal SrcR'.

The corrected signals SrcL' and SrcR' are obtained by the following equations (2) and (3), where Amp1 is the subtraction ratio, which can have a value of 0% to 100%.

$$SrcL'=SrcL-SrcIp*Amp1 \quad (2)$$

$$SrcR'=SrcR-SrcIp*Amp1 \quad (3)$$

Figure 5:
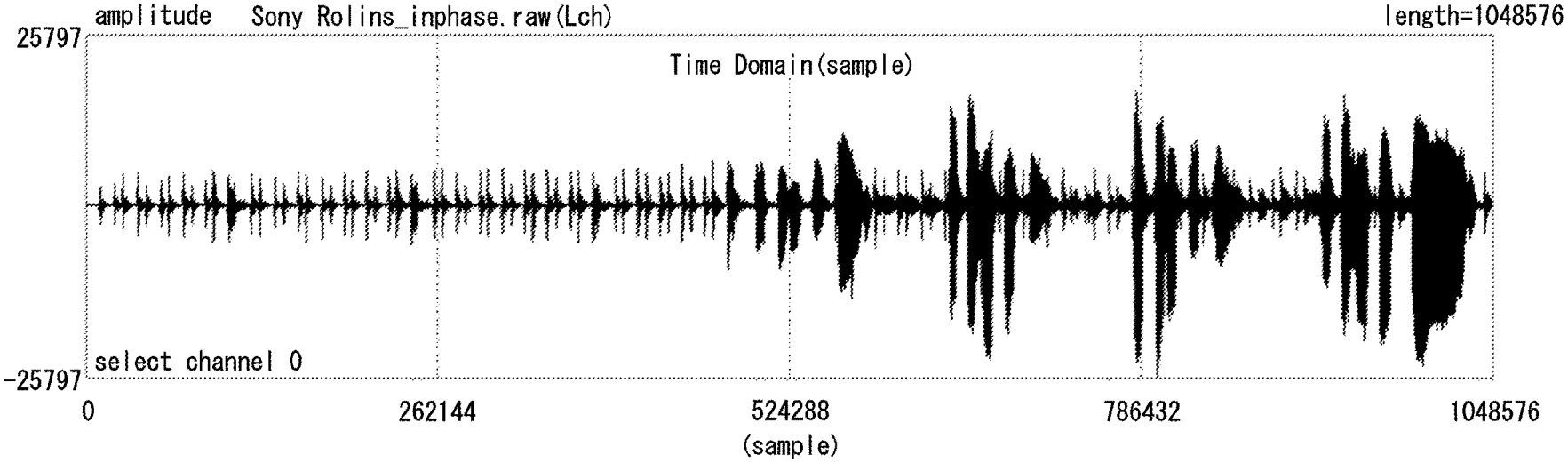
FIG. 5 is a view showing the waveform of a corrected signal SrcL'.
Figure 6:
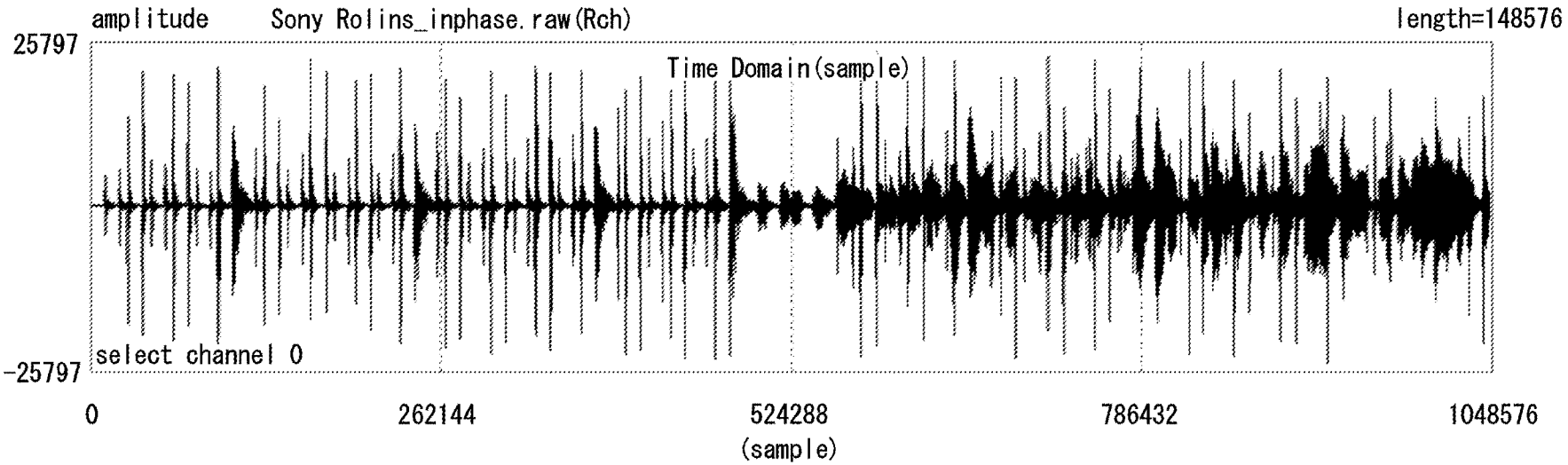
FIG. 6 is a view showing the waveform of a corrected signal SrcR'.

FIGS. 5 and 6 show examples of the corrected signals SrcL' and SrcR'. FIG. 5 is a waveform chart showing the Lch corrected signal SrcL'. FIG. 6 is a waveform chart showing the Rch corrected signal SrcR'. The subtraction ratio Amp1 is 50% in this example. In this manner, the subtractor 53 subtracts the common-mode signal SrcIp from the stereo input signals SrcL and SrcR in accordance with the subtraction ratio.

The ratio setting unit 52 multiplies the subtraction ratio Amp1 by the common-mode signal SrcIp and outputs a result to the subtractors 53 and 54. The ratio setting unit 52 stores a coefficient m for setting the subtraction ratio Amp1. The coefficient m is set in accordance with a reproduced volume chVol. To be specific, the ratio setting unit 52 stores a coefficient table where the coefficient m and the reproduced volume chVol are associated with each other. The ratio setting unit 52 changes the coefficient m in accordance with the reproduced volume chVol acquired by the volume acquisition unit 61, which is described later. It is thereby possible to set an appropriate subtraction ratio Amp1 in accordance with the reproduced volume chVol.

Further, the stereo input signals SrcL and SrcR are input to the correlation determination unit 56 in order to determine how much of the common-mode component is contained in the stereo input signals SrcL and SrcR. The correlation determination unit 56 determines a correlation between the Lch stereo input signal SrcL and the Rch stereo input signal SrcR. For example, the correlation determination unit 56 calculates a cross-correlation function of the Lch stereo input signal SrcL and the Rch stereo input signal SrcR. The correlation determination unit 56 then determines whether a correlation is high or not based on the cross-correlation function. For example, the correlation determination unit 56 makes a determination based on a result of comparing the cross-correlation function with a correlation threshold.

Generally, the cross-correlation function of 1 (100%) indicates the state of a correlation where two signals match, the cross-correlation function of 0 indicates the state of a decorrelation where there is no correlation, and the cross-correlation function of −1 (−100%) indicates the state of an inverse correlation where two signals match when one of the signals is reversed between positive and negative. In this example, a correlation threshold is set for the cross-correlation function to compare the cross-correlation function with the correlation threshold. A correlation is high when the cross-correlation function is equal to or more than the correlation threshold, and a correlation is low when the cross-correlation function is less than the correlation threshold. The correlation threshold may be 80%, for example. The correlation threshold is always set to a positive value.

When a correlation is low, the correction unit 50 does not perform correction processing, and the stereo input signals SrcL and SrcR are input to the out-of-head localization unit 10 without any change. In other words, the correction unit 50 outputs the stereo input signals SrcL and SrcR without subtracting the common-mode signal from them. Thus, the corrected signals SrcL' and SrcR and the stereo input signals SrcL and SrcR are respectively the same. In other words, Amp1 in the equations (2) and (3) is 0.

When, on the other hand, a correlation is high, the correction unit 50 subtracts a signal obtained by multiplying the common-mode signal SrcIp by the subtraction ratio Amp1 from the stereo input signals SrcL and SrcR and outputs results as the corrected signals SrcL' and SrcR'. Specifically, the correction unit 50 calculates the corrected signals SrcL' and SrcR' based on the equations (2) and (3). This generates the stereo corrected signals SrcL' and SrcR' where the ratio of the common-mode component in the stereo input signals SrcL and SrcR is adjusted.

As described above, when a correlation meets specified conditions, the subtractors 53 and 54 perform subtraction. Then, convolution calculation units 11, 12, 21 and 22 perform convolution processing on the corrected signals SrcL' and SrcR' where the common-mode signal SrcIp is subtracted from the stereo input signals SrcL and SrcR. On the other hand, when a correlation does not meet specified conditions, the subtractors 53 and 54 do not perform subtraction and the convolution calculation units 11, 12, 21 and 22 perform convolution processing on the stereo input signals SrcL and SrcR as the corrected signals SrcL' and SrcR'. Thus, the convolution calculation units 11, 12, 21 and 22 perform convolution processing on the stereo input signals SrcL and SrcR. A cross-correlation function may be used as a correlation, for example. Then, the correction unit 50 determines whether or not to perform subtraction based on a result of comparing the cross-correlation function with a correlation threshold.

The out-of-head localization unit 10 includes convolution calculation units 11 to 12, convolution calculation units 21 to 22, amplifiers 13 and 14, amplifiers 23 and 24, and adders 26 and 27. The convolution calculation units 11 to 12 and 21 to 22 perform convolution processing using the spatial acoustic transfer characteristics. The corrected signals SrcL' and SrcR' from the correction unit 50 are input to the out-of-head localization unit 10.

The spatial acoustic transfer characteristics are set to the out-of-head localization unit 10. The out-of-head localization unit 10 convolves the spatial acoustic transfer characteristics into each of the corrected signals SrcL' and SrcR' having the respective channels. The spatial acoustic transfer characteristics may be a head-related transfer function (HRTF) measured in the user U's head or auricle, or may be the head-related transfer function of a dummy head or a third person. Those transfer characteristics may be measured on sight, or may be prepared in advance.

The spatial acoustic transfer characteristics are four transfer characteristics from the speakers to the ears, including transfer characteristics Hls from SpL to the left ear, transfer characteristics Hlo from SpL to the right ear, transfer characteristics Hro from SpR to the left ear, and transfer characteristics Hrs from SpR to the right ear. The convolution calculation unit 11 convolves the transfer characteristics Hls to the Lch corrected signal SrcL'. The convolution calculation unit 11 outputs a convolution calculation signal to the adder 26 through the amplifier 13. The convolution calculation unit 21 convolves the transfer characteristics Hro to the Rch corrected signal SrcR'. The convolution calculation unit 21 outputs a convolution calculation signal to the adder 26 through the amplifier 23. The adder 26 adds the two convolution calculation signals and outputs a result to the filter unit 41.

The convolution calculation unit 12 convolves the transfer characteristics Hlo to the Lch corrected signal SrcL'. The convolution calculation unit 12 outputs a convolution calculation signal to the adder 27 through the amplifier 14. The convolution calculation unit 22 convolves the transfer characteristics Hrs to the Rch corrected signal SrcR'. The convolution calculation unit 22 outputs a convolution calculation signal to the adder 27 through the amplifier 24. The adder 27 adds the two convolution calculation signals and outputs a result to the filter unit 42.

Note that the amplifiers 13, 14, 23 and 24 amplify the convolution calculation signal at a specified gain Amp2. The gain Amp2 of the amplifiers 13, 14, 23 and 24 may be the same or different.

The volume acquisition unit 61 acquires a reproduced volume (or reproduced sound pressure level) chVol in accordance with the gain Amp2 of the amplifiers 13, 14, 23 and 24. A method of acquiring the volume chVol is not particularly limited. A user may acquire the volume chVol by a volume (Vol) of the headphones 45 or a smartphone operated by a user. Alternatively, the volume chVol may be acquired based on output signals outL and outR, which are described later. The volume acquisition unit 61 outputs the volume chVol to the ratio setting unit 52.

Figure 7:
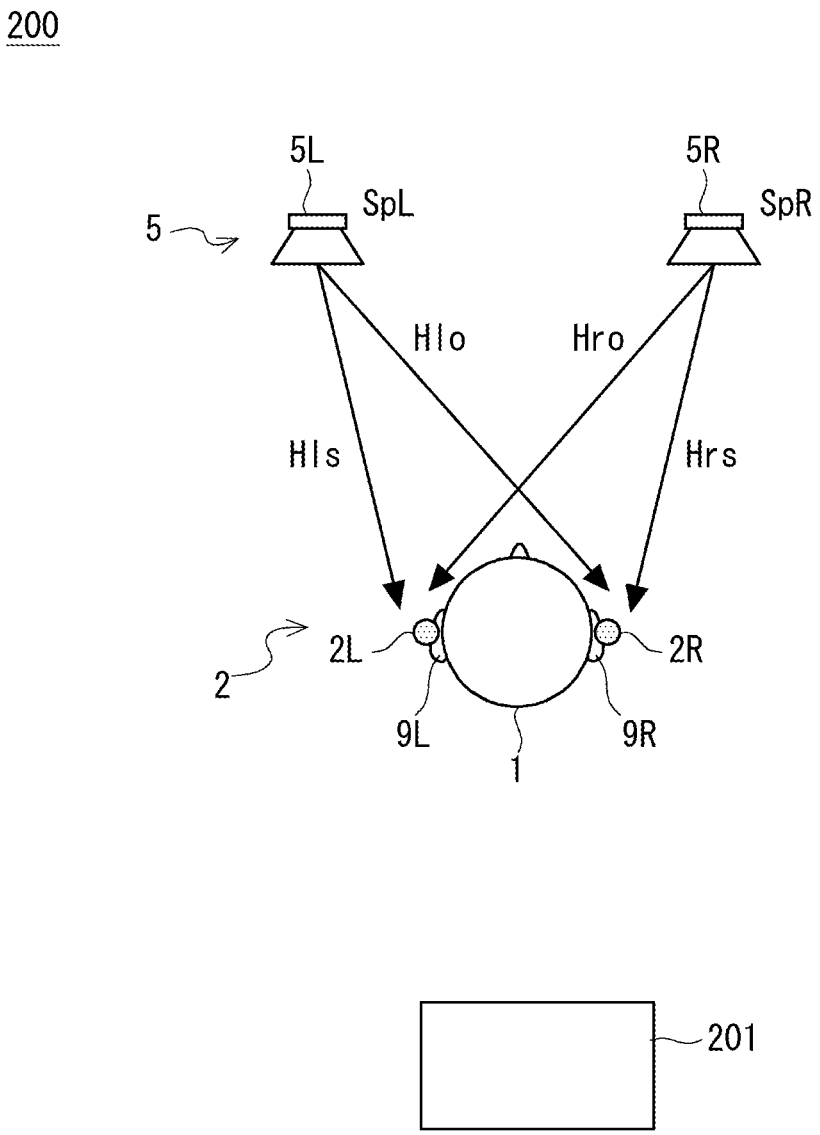
FIG. 7 is a view showing the structure to measure transfer characteristics.

The four transfer characteristics Hls, Hlo, Hro and Hrs are described hereinafter with reference to FIG. 7. FIG. 7 is a schematic view showing a filter generation device 200 for measuring the four transfer characteristics Hls, Hlo, Hro and Hrs. The filter generation device 200 includes a stereo speaker 5 and a stereo microphone 2. Further, the filter generation device 200 includes a processing device 201. The processing device 201 stores a sound pickup signal into a memory or the like. The processing device 201 is an arithmetic processing unit including a memory, a processor and the like, and it is, to be specific, a personal computer or the like. The processing device 201 performs processing according to a computer program stored in advance.

The stereo speaker 5 includes a left speaker 5L and a right speaker 5R. For example, the left speaker 5L and the right speaker 5R are placed in front of a listener 1. The left speaker 5L and the right speaker 5R output a measurement signal for measuring the spatial acoustic transfer characteristics from the speakers to the ears. For example, the measurement signal may be an impulse signal, a TSP (Time Stretched Pulse) signal or the like.

The stereo microphone 2 includes a left microphone 2L and a right microphone 2R. The left microphone 2L is placed on a left ear 9L of the listener 1, and the right microphone 2R is placed on a right ear 9R of the listener 1. To be specific, the microphones 2L and 2R are preferably placed at arbitrary positions from the entrance of the ear canal to the eardrum of the left ear 9L and the right ear 9R, respectively. The microphones 2L and 2R may be placed at any positions between the entrance of the ear canal and the eardrum. The microphones 2L and 2R pick up measurement signals output from the stereo speakers 5 and acquire sound pickup signals.

The listener 1 may the same person as or a different person from the user U of the out-of-head localization device 100. The listener 1 may be a person or a dummy head. In this embodiment, the listener 1 is a concept that includes not only a person but also a dummy head.

As described above, the spatial transfer characteristics are measured by picking up the measurement signals output from the left and right speakers 5L and 5R by the microphones 2L and 2R, respectively. The processing device 201 stores the measured spatial transfer characteristics into a memory. The transfer characteristics Hls from the left speaker 5L to the left microphone 2L, the transfer characteristics Hlo from the left speaker 5L to the right microphone 2R, the transfer characteristics Hro from the right speaker 5R to the left microphone 2L, and the transfer characteristics Hrs from the right speaker 5R to the right microphone 2R are thereby measured. Specifically, the left microphone 2L picks up the measurement signal that is output from the left speaker 5L, and thereby the transfer characteristics Hls are acquired. The right microphone 2R picks up the measurement signal that is output from the left speaker 5L, and thereby the transfer characteristics Hlo are acquired. The left microphone 2L picks up the measurement signal that is output from the right speaker 5R, and thereby the transfer characteristics Hro are acquired. The right microphone 2R picks up the measurement signal that is output from the right speaker 5R, and thereby the transfer characteristics Hrs are acquired.

Then, the processing device 201 generates filters in accordance with the transfer characteristics Hls to Hrs from the left and right speakers 5L and 5R to the left and right microphones 2L and 2R based on the sound pickup signals. To be specific, the processing device 201 cuts out the transfer characteristics Hls to Hrs with a specified filter length and generates them as filters to be used for the convolution calculation of the out-of-head localization unit 10. As shown in FIG. 1, the out-of-head localization device 100 performs out-of-head localization by using the transfer characteristics Hls to Hrs between the left and right speakers 5L and 5R and the left and right microphones 2L and 2R. Specifically, the out-of-head localization is performed by convolving the corrected signals SrcL' and SrcR' to the transfer characteristics Hls to Hrs.

Referring back to FIG. 1, inverse filters Linv and Rinv that cancel out the ear canal transfer characteristics (which are also called headphone characteristics) from the headphones 45 to the microphones 2L and 2R are set to the filter units 41 and 42. Then, the inverse filters Linv and Rinv are respectively convolved to the convolution calculation signals added by the adders 26 and 27. The filter unit 41 convolves the inverse filter Linv to the Lch convolution calculation signal from the adder 26. Likewise, the filter unit 42 convolves the inverse filter Rinv to the Rch convolution calculation signal from the adder 27. The inverse filters Linv and Rinv cancel out the characteristics from an output unit of the headphones 45 to the microphone when the headphones 45 are worn. Specifically, when the microphone is placed near the entrance of the ear canal, the transfer characteristics between the entrance of the ear canal of a user and a reproduction unit of the headphones or between the eardrum of a user and a reproduction unit of the headphones are cancelled out. The microphone may be placed at any position between the entrance of the ear canal and the eardrum. The inverse filters Linv and Rinv may be calculated from a result of measuring the characteristics of the user U on sight, or the inverse filters calculated from the headphone characteristics measured using the outer ear of a dummy head, a third person or the like may be prepared in advance.

To generate the inverse filters, a left unit 45L outputs a measurement signal toward the left ear 9L of the listener 1. A right unit 45R outputs a measurement signal toward the right ear 9R of the listener 1.

The left microphone 2L is placed on the left ear 9L of the listener 1, and the right microphone 2R is placed on the right ear 9R of the listener 1. To be specific, the microphones 2L and 2R are preferably placed at arbitrary positions from the entrance of the ear canal to the eardrum of the left ear 9L and the right ear 9R, respectively. The microphones 2L and 2R may be placed at any positions between the entrance of the ear canal and the eardrum. The microphones 2L and 2R pick up measurement signals output from the headphones 45 or the like and acquire sound pickup signals. Specifically, measurement is performed while the listener 1 is wearing the headphones 45 and the stereo microphones 2. For example, the measurement signal may be an impulse signal, a TSP (Time Stretched Pulse) signal or the like. The inverse characteristics of the headphone characteristics are calculated based on the sound pickup signals, and the inverse filters are thereby generated.

The filter unit 41 outputs a filtered Lch output signal outL to the D/A converter 43. The D/A converter 43 converts the output signal outL from digital to analog and outputs the converted signal to the left unit 45L of the headphones 45.

The filter unit 42 outputs a filtered Rch output signal outR to the D/A converter 44. The D/A converter 44 converts the output signal outR from digital to analog and outputs the converted signal to the right unit 45R of the headphones 45.

The user U is wearing the headphones 45. The headphones 45 output the Lch output signal and the Rch output signal toward the user U. It is thereby possible to reproduce sound images localized outside the head of the user U.

As described above, the common-mode signal SrcIp is subtracted from the stereo input signals SrcL and SrcR by the correction unit 50 in this embodiment. This achieves out-of-head localization listening where the common-mode signal SrcIp is corrected to an appropriate volume so as to equal a speaker sound field by reducing the common-mode component enhanced by a change in volume or the binaural effect as a result of reproduction by headphones. This enables appropriate sound localization. For example, it is possible to suppress the localization of sound images such as vocals localized at the phantom center generated by the out-of-head localization headphones from being emphasized by a change in volume or the binaural effect. It is thereby possible to prevent sound images localized at the phantom center generated by the out-of-head localization headphones from being heard closely.

In the correction unit 50, the subtraction ratio Amp1 is variable. The ratio setting unit 52 changes the subtraction ratio Amp1 of the common-mode signal depending on the reproduced volume chVol. Specifically, the ratio setting unit 52 changes the value of the subtraction ratio Amp1 upon change of the reproduced volume chVol. In this manner, it is possible to appropriately perform sound localization depending on the reproduced volume chVol even when the reproduced volume chVol is changed. Specifically, it is possible to suppress sound images localized at the phantom center from being emphasized by the binaural effect even when the reproduced volume chVol is changed.

Correction Process

Figure 8:
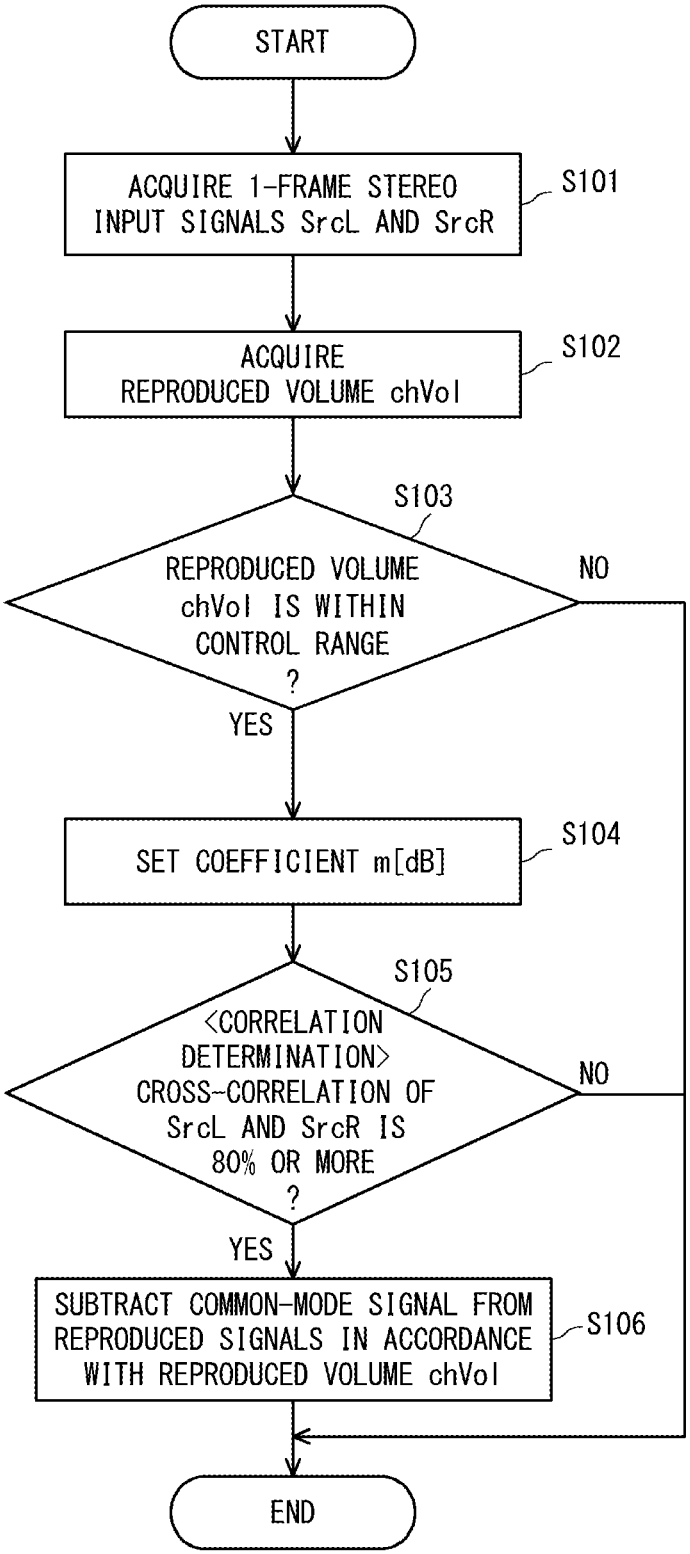
FIG. 8 is a flowchart showing a correction process.

A correction process in the correction unit 50 is described hereinafter with reference to FIG. 8. FIG. 8 is a flowchart showing a correction process in the correction unit 50. The process shown in FIG. 8 is performed by the correction unit 50 in FIG. 1. To be specific, a processor of the out-of-head localization device 100 executes a computer program, and thereby the process of FIG. 8 is performed.

In this example, a coefficient m [dB] is set as a coefficient for calculating the subtraction ratio Amp1. The coefficient m [dB] is stored in the ratio setting unit 52 as a coefficient table in accordance with the reproduced volume chVol. Note that the coefficient m [dB] is a value indicating by how much dB the stereo input signals SrcL and SrcR are to be reduced.

First, the correction unit 50 acquires 1 frame from the stereo input signals SrcL and SrcR (S101). Next, the volume acquisition unit 61 acquires the reproduced volume chVol (S102).

Then, the volume acquisition unit 61 determines whether the reproduced volume chVol is within a control range, which is described later (S103). When the reproduced volume chVol is outside the control range (No in S103), the correction unit 50 does not make a correction and the process ends. Thus, the correction unit 50 outputs the stereo input signals SrcL and SrcR without any change.

When the reproduced volume chVol is within a control range (Yes in S103), the ratio setting unit 52 refers to the coefficient table and sets the coefficient m [dB] (S104). As described above, the reproduced volume chVol is input from the volume acquisition unit 61 to the ratio setting unit 52. In the coefficient table, the reproduced volume chVol and the coefficient m [dB] are associated with each other. The ratio setting unit 52 can set an appropriate subtraction ratio Amp1 in accordance with the reproduced volume chVol. The ratio setting unit 52 stores the coefficient table in advance. Generation of the coefficient table is described later.

Then, the correlation determination unit 56 performs correlation determination of the stereo input signals SrcL and SrcR one frame by one frame (S105). To be specific, the correlation determination unit 56 determines whether the cross-correlation function of the stereo input signals SrcL and SrcR is equal to or more than the correlation threshold (e.g., 80%).

The cross-correlation function $\varphi_{12}$ is given by the following equation (4):

$$\varnothing_{12} = \frac{\int g1(x)g2(x-\tau)dx}{\sqrt{\int (g1(x))^2(g2(x))^2 dx}} \tag{4}$$

g1(x) is the stereo input signal SrcL for 1 frame, and g2(x) is the stereo input signal SrcR for 1 frame. In the equation (4), the cross-correlation function is normalized so that the cross-correlation is 1.

When the cross-correlation function is smaller than the correlation threshold (No in S105), the process ends without making any correction. When a correlation between the stereo input signals SrcL and SrcR is low, that is, when the common-mode signal SrcIp of the stereo input signals SrcL and SrcR has less common-mode component, there is less common-mode signal that can be extracted, and it is not necessary to perform correction processing.

Note that the correlation threshold may be varied according to music or musical genre to be reproduced. For example, the correlation threshold of classical music may be 90%, the correlation threshold of jazz music may be 80%, and the correlation threshold of music where more vocals are at the phantom center such as JPOP may be 65% or the like.

When the cross-correlation function is equal to or more than the correlation threshold (Yes in S105), the subtractors 53 and 54 subtract the common-mode signal SrcIp from the stereo input signals SrcL and SrcR at the subtraction ratio Amp1 (S106). Thus, the corrected signals SrcL' and SrcR' are calculated based on the equation (2) and the equation (3).

After that, the processing of S101 to S106 is repeated during reproduction of the stereo input signals SrcL and SrcR. Specifically, the processing of S101 to S106 is performed for each frame. Thus, upon occurrence of a change in the reproduced volume chVol, because a change in volume is detected for each frame, it is updated to the coefficient m in accordance with the reproduced volume chVol even during reproduction of the stereo input signals SrcL and SrcR.

The coefficient m [dB] is in units of decibels [dB]. Therefore, the subtraction ratio Amp1 for the coefficient m [dB] to the stereo input signals SrcL and SrcR can be obtained by the following equation (5):

$$m\ [\mathrm{dB}]=20*\log_{10}(\mathrm{Amp1})$$

$$\mathrm{Amp1}=10^{(m/20)} \tag{5}$$

For example, when m=−6 [dB], Amp1=10^(−6/20)=0.5 times=50%. The corrected signals SrcL' and SrcR' are given by the following equations (6) and (7):

$$\mathrm{SrcL'}=\mathrm{SrcL}-\mathrm{SrcIp}*10^{(m/20)} \tag{6}$$

$$\mathrm{SrcR'}=\mathrm{SrcR}-\mathrm{SrcIp}*10^{(m/20)} \tag{7}$$

The subtraction ratio Amp1 is in a range more than 0% and less than 100%. Accordingly, the coefficient m [dB] is in a range of $0<10^{(m/20)}<100$. For example, Amp1=0% results in no correction. When m=0, Amp1=100%, and a range of application of the coefficient m can be defined by the following equation (8):

$$-\infty<m<0 \tag{8}$$

As described above, the correction unit 50 subtracts a signal obtained by multiplying the common-mode signal SrcIp by the subtraction ratio Amp1 from the stereo input signals SrcL and SrcR and thereby generates the corrected signals SrcL' and SrcR'. Based on the corrected signals SrcL' and SrcR', the out-of-head localization unit 10, the filter unit 41 and the filter unit 42 perform processing. This enables appropriate out-of-head localization, and it is possible to suppress sound images localized at the phantom center from being emphasized by a change in volume or the binaural effect. By using the coefficient table of the coefficient m [dB], an appropriate correction can be made.

Further, in this embodiment, the correction unit 50 changes the subtraction ratio Amp1 depending on the reproduced volume. This prevents only phantom center sound images from coming closer to the user U even when the user U raises the reproduced volume. It is thereby possible to appropriately perform out-of-head localization and re-create sound fields that are equal to speaker sound fields. The subtraction ratio may be changed by user input. For example, when a user feels that sound images localized at the phantom center are too close, the user performs an operation to increase the subtraction ratio. This achieves appropriate out-of-head localization.

Further, the correction unit 50 determines whether or not to make a correction based on a correlation between the stereo input signals SrcL and SrcR. When a correlation between the stereo input signals SrcL and SrcR is low, the common-mode component is hardly contained, and a correction is less effective, and therefore correction processing is not performed. Thus, SrcL'=SrcL, SrcR'=SrcR. In this manner, it is possible to omit unnecessary correction processing and thereby reduce the amount of arithmetic processing.

Further, the coefficient m [dB] can be target speaker characteristics (coefficient). The coefficient m [dB] that equals the volume of phantom sound images of speakers can be set from the relationship between the volume of sound images localized at the phantom center of out-of-head localization headphones and the volume of sound images localized at the phantom center of speakers. The coefficient m [dB] is calculated from the coefficient table that is obtained by the following testing.

The testing conducted to obtain the coefficient table is described hereinafter. Testing for verifying whether the binaural effect varies depending on a reproduction method was conducted for the volume of phantom center sound images generated by stereo speakers and the volume of phantom center sound images generated by stereo headphones and out-of-head localization headphones.

However, it has been difficult to simply compare the volume of phantom center sound images generated by stereo headphones or out-of-head localization headphones and the volume of phantom center sound images generated by stereo speakers. Further, because the volume of the phantom center is a sensory amount, it has been necessary to evaluate and compare the volumes after replacing them with physical indices.

In view of the above, the volume of phantom center sound images generated by stereo speakers and the volume of phantom center sound images generated by stereo headphones and out-of-head localization headphones are compared relatively by placing a center speaker (see FIG. 9) in front of the listener 1 and, with reference to the volume of a sound image generated by the center speaker, comparing the volume of the sound image of the center speaker with the volume of phantom center sound images generated by the stereo speakers, and the volume of the sound image of the center speaker with the volume of phantom center sound images generated by the stereo headphones and the out-of-head localization headphones.

To be specific, the sound pressure level at the ear when the volume of the sound image generated by the center speaker and the volume of phantom center sound images generated by the stereo speakers are heard at the same level is obtained. Next, the sound pressure level at the ear when the volume of the sound image generated by the center speaker and the volume of phantom center sound images generated by the stereo headphones and the out-of-head localization headphones are heard at the same level is obtained. The at-the-ear sound pressure level of the volume of phantom center sound images generated by the stereo speakers and the at-the-ear sound pressure level of the volume of phantom center sound images generated by the stereo headphones and the out-of-head localization headphones are thereby compared using the at-the-ear sound pressure level of the volume of the sound image generated by the center speaker.

Using the at-the-ear sound pressure level of the volume of the sound image generated by the center speaker as a reference sound pressure level, a graph of the at-the-ear sound pressure level that plots changes of the sound pressure level of phantom center sound images generated by the stereo speakers and the sound pressure level of phantom center sound images generated by the stereo headphones and the out-of-head localization headphones with respect to the reference sound pressure level when the reproduced volume of the stereo speakers, the stereo headphones and the out-of-head localization headphones is raised by 5 [dB] each time is obtained.

Figure 9:
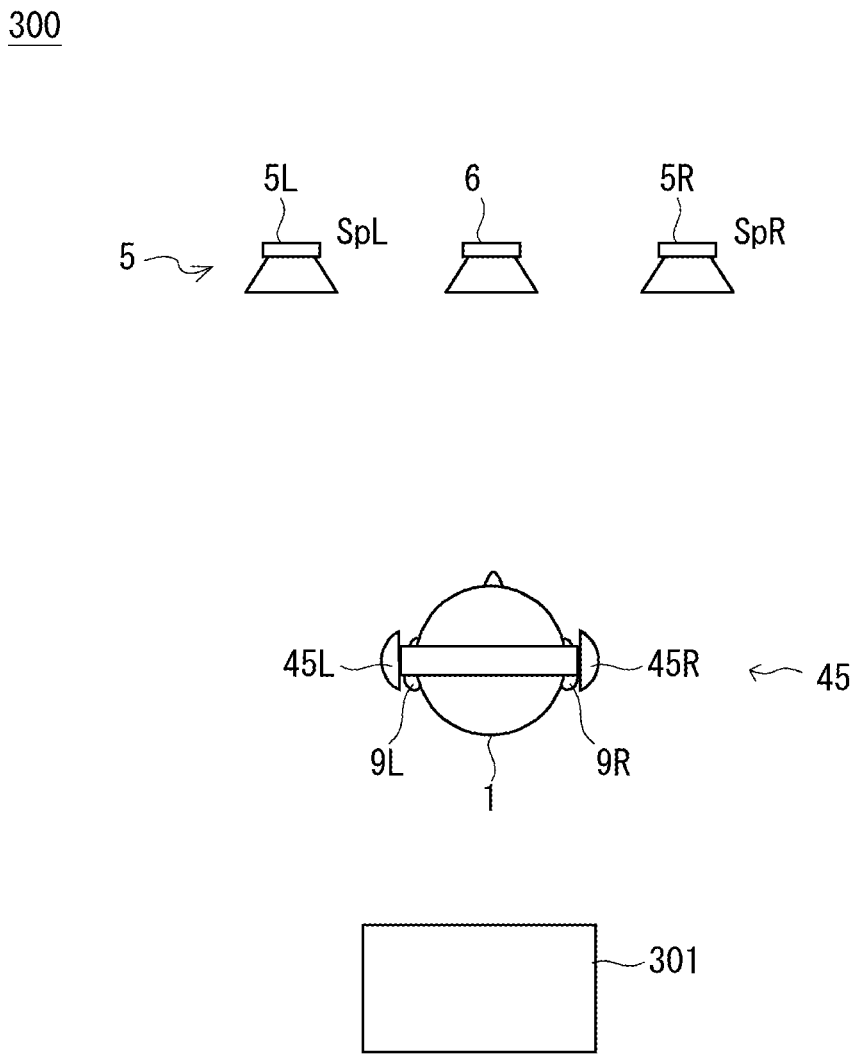
FIG. 9 is a view showing the structure to perform auditory testing for comparing at-the-ear sound pressure levels at phantom centers created by stereo speakers, stereo headphones and out-of-head localization headphones.

This testing uses a measurement device 300 shown in FIG. 9. The measurement device 300 includes headphones 45, a stereo speaker 5, a center speaker 6, and a processing device 301. The processing device 301 is an arithmetic processing unit including a memory, a processor and the like, and it is, to be specific, a personal computer or the like. The processing device 301 performs processing according to a computer program stored in advance. For example, the processing device 301 outputs signals for testing (e.g., white noise) to the stereo speaker 5 and the headphones 45.

The stereo speaker 5 has the same structure as that of FIG. 7. A left speaker 5L and a right speaker 5R are placed at the same spread angle on a horizontal plane when the normal to the listener 1 is 0° and placed at an equal distance from the listener 1. It is preferably placed at the same distance and angle as the speaker placement shown in FIG. 7.

The center speaker 6 is placed at the midpoint between the left speaker 5L and the right speaker 5R. The center speaker 6 is thus placed in front of the listener 1. Therefore, the left speaker 5L is placed on the left of the center speaker 6, and the right speaker 5R is placed on the right of the center speaker 6.

When outputting signals from the headphones 45, the listener 1 wears the headphones 45. When outputting signals from the stereo speaker 5 or the center speaker 6, the listener 1 removes the headphones 45.

First, at the reference sound pressure level of 72 [dB], the present inventors presented white noise from the stereo speaker 5, the stereo headphones, the out-of-head localization headphones and the center speaker as a reference in such a way that the sound pressure level is the same at the ear to thereby match the gains of the respective output systems. Next, when the reference sound pressure level is changed by ±5 [dB] each time, the inventors obtained, by auditory testing, the volume where the sound image localized at the phantom center is heard at the same volume with respect to the reference sound pressure level in the following (a) to (c), and generated a graph by plotting changes in the sound pressure level at the ear.

(a) Phantom center sound images generated by stereo speakers (which are referred to hereinafter as stereo speaker phantom sound images)

(b) Phantom center sound images generated by stereo headphones (which are referred to hereinafter as headphone-through phantom sound images)

(c) Phantom center sound images generated by out-of-head localization headphones (which are referred to hereinafter as out-of-head localization headphone phantom sound images)

As a result of comparing the graphs of (a) to (c) indicating the sound pressure level at the ear, it was found that the at-the-ear sound pressure levels of headphone through and out-of-head localization headphone phantom sound images are higher than the at-the-ear sound pressure level of stereo speaker phantom sound images in a certain range. Thus, it was found that the binaural effect is higher when reproduced by headphones than by speakers.

In the present disclosure, a developer conducts the above testing and calculates a coefficient from the graph of the sound pressure level. The present disclosure uses the coefficient table calculated from a result of the testing described above.

Figure 10:
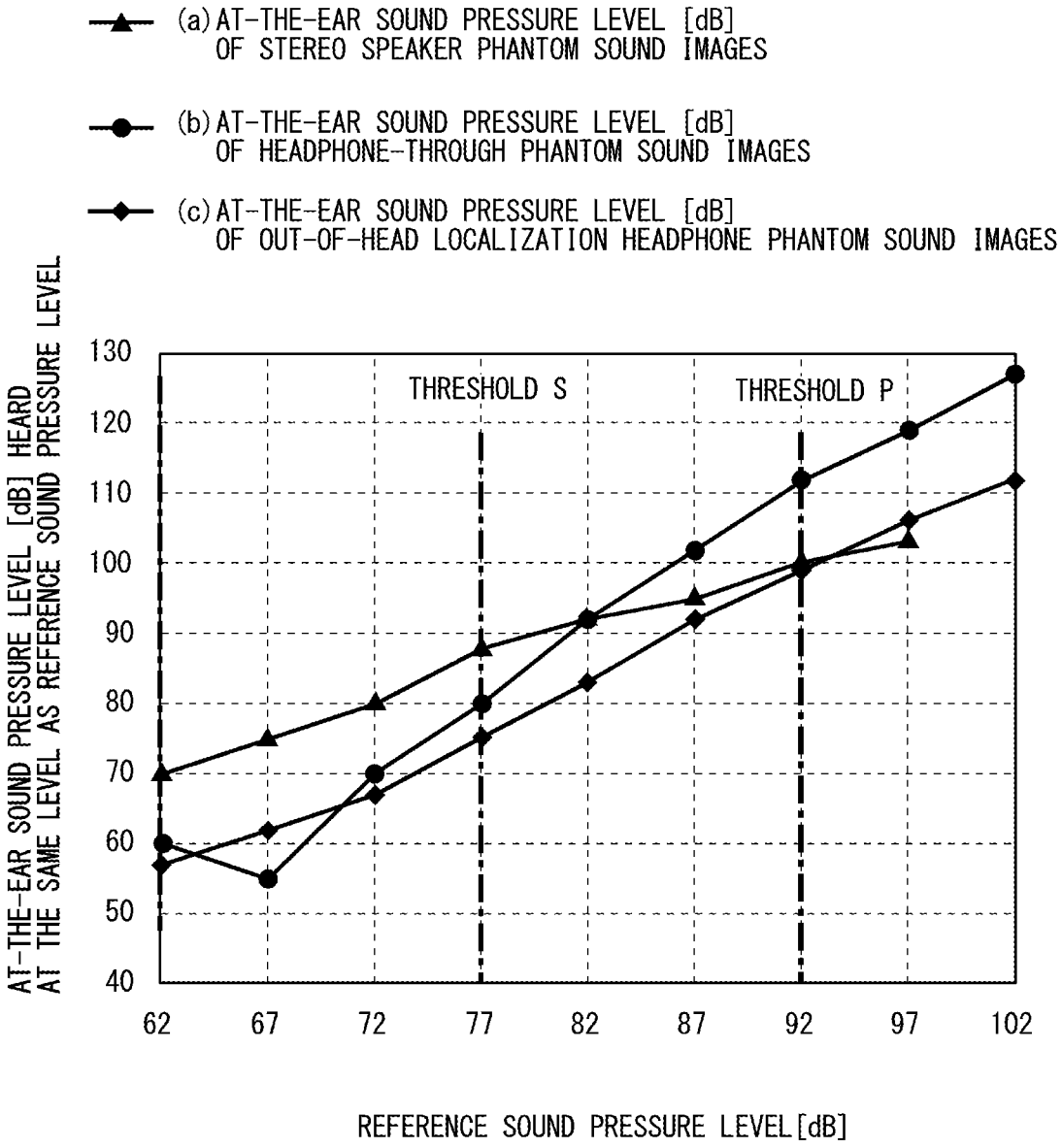
FIG. 10 is a graph evaluating, by auditory testing, at-the-ear sound pressure levels of the volume of a phantom center sound image in open headphones.
Figure 11:
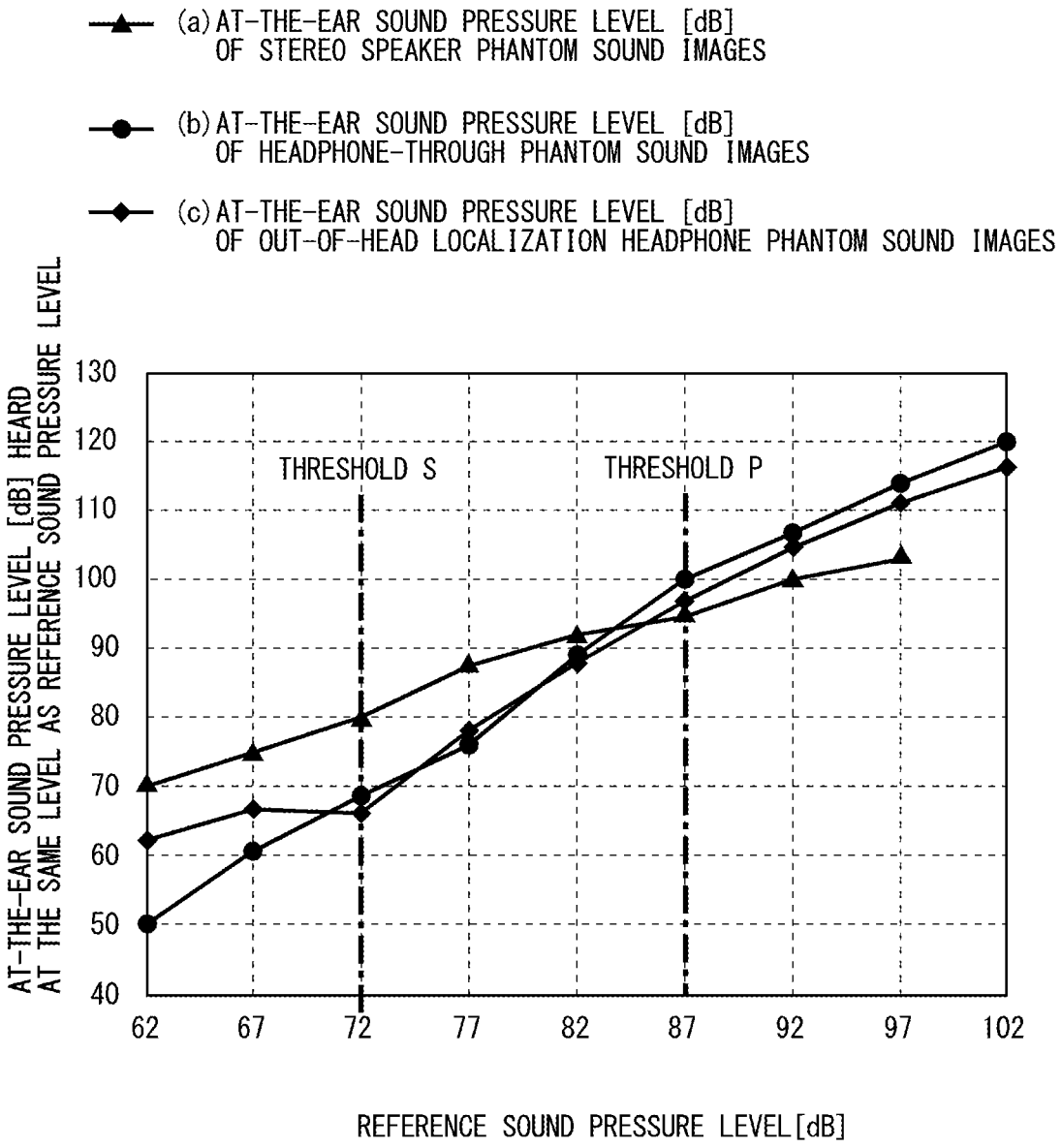
FIG. 11 is a graph evaluating, by auditory testing, at-the-ear sound pressure levels of the volume of a phantom center sound image in closed headphones.

Based on a result of the above-described testing, FIGS. 10 and 11 show graphs showing the evaluation of the at-the-ear sound pressure level of phantom sound images compared using the reference sound pressure level in the auditory testing for (a) stereo speaker phantom sound image, (b) headphone-through phantom sound image and (c) out-of-head localization headphone phantom sound image. FIG. 10 is a graph showing a result when using open headphones as the headphones 45. FIG. 11 shows a graph showing a result when using closed headphones as the headphones 45.

Further, FIGS. 10 and 11 show graphs that plot the sound pressure levels at the ear when the sound pressure levels of the respective phantom centers of (a) to (c) are heard at the same volume in an auditory sense with reference to the reference sound pressure level when the reference sound pressure level is changed by 5 [dB] each time in the range of 62 [dB] to 97 [dB]. In FIGS. 10 and 11, the horizontal axis indicates the reference sound pressure level [dB]. The vertical axis indicates the at-the-ear sound pressure level [dB] of each phantom center sound image that is heard at the same level as the reference sound pressure level obtained from an auditory sense.

For example, at the reference sound pressure level of 72 dB in FIG. 10, the at-the-ear sound pressure level of the (a) stereo speaker phantom sound image indicates 80 dB. This means that, when the volume of a sound image generated by the center speaker, which is the reference sound pressure level, is presented at 72 dB, the same volume is heard if the at-the-ear sound pressure level of the (a) stereo speaker phantom sound image is presented at 80 dB.

Further, at the reference sound pressure level of 72 dB in FIG. 10, the at-the-ear sound pressure level of the (c) out-of-head localization headphone phantom sound image indicates 67 dB. This means that, when the volume of a sound image generated by the center speaker, which is the reference sound pressure level, is presented at 72 dB, the same volume is heard if the at-the-ear sound pressure level of the (c) out-of-head localization headphone phantom sound image is presented at 67 dB.

This result shows that, when the same reference sound pressure level of 72 dB is presented, the sound pressure level at the ear is different between the (a) stereo speaker phantom sound and the (c) out-of-head localization headphone phantom sound image depending on the way of presenting the sound. It also shows that the (c) out-of-head localization headphone phantom sound image is heard at the same volume with the less sound pressure level than the (a) stereo speaker phantom sound image.

Further, at the reference sound pressure level of 62 dB in FIG. 10, the at-the-ear sound pressure level of the (a) stereo speaker phantom sound image is higher than the at-the-ear sound pressure level of the (b) headphone-through phantom sound image and the (c) out-of-head localization headphone phantom sound image by 10 to 12 [dB]. In other words, the at-the-ear sound pressure level of the (a) stereo speaker phantom sound image is heard at the same level in an auditory sense as the at-the-ear sound pressure level of the (b) headphone-through phantom sound image and the (c)

out-of-head localization headphone phantom sound image regardless of the fact that it is actually higher by 10 to 12 [dB]. Accordingly, when using the headphones 45, the binaural effect is higher than when using the stereo speaker 5. Specifically, comparing the graphs of three sound pressure levels when the reference sound pressure level indicated by the horizontal axis is the same, the binaural effect is more significant as a difference in the sound pressure level from the speaker is greater.

Further, at the reference sound pressure level of 92 [dB] in FIG. 10, the sound pressure level at the ear is equal between the (a) stereo speaker phantom sound image and the (c) out-of-head localization headphone phantom sound image. Thus, at the reference sound pressure level of 92 [dB], the at-the-ear sound pressure level of the (a) stereo speaker phantom sound image and the at-the-ear sound pressure level of the (c) out-of-head localization headphone phantom sound image are heard at the same level in an auditory sense. Therefore, at the reference sound pressure level of 92 [dB] or higher, the binaural effect by the headphones is not significant, and the volume of phantom center sound images is not enhanced.

On the other hand, at the reference sound pressure level of 97 [dB] in FIG. 10, the at-the-ear sound pressure level of the (a) stereo speaker phantom sound image is lower than the at-the-ear sound pressure level of the (c) out-of-head localization headphone phantom sound image. Thus, at the reference sound pressure level of 97 [dB], the at-the-ear sound pressure levels of the phantom center sound images of the stereo speakers and the out-of-head localization headphones are reversed. Specifically, at the reference sound pressure level of 97 [dB], which is higher than 92 [dB], the volume of the phantom center presented by the headphones is heard at a higher volume than the actual stereo speaker.

Further, in FIG. 10, the slope of the graph is different between the (a) stereo speaker phantom sound image and the (c) out-of-head localization headphone phantom sound image. Thus, the degree of increase in the sound pressure level is different between the (a) stereo speaker phantom sound image and the (c) out-of-head localization headphone phantom sound image. To be specific, the slope of the graph of the (a) stereo speaker phantom sound image is less than the slope of the graph of the (c) out-of-head localization headphone phantom sound image. This means that the degree of increase in the sound pressure level when the reference volume is raised is different between the (a) stereo speaker phantom sound image and the (c) out-of-head localization headphone phantom sound image. Therefore, it is necessary to set the degree of increase in the sound pressure level separately for the (a) stereo speaker phantom sound image and the (c) out-of-head localization headphone phantom sound image. Further, because the slope of the graph is different also between (b) and (c), this is the same as the case of (a) and (c).

Figure 12:
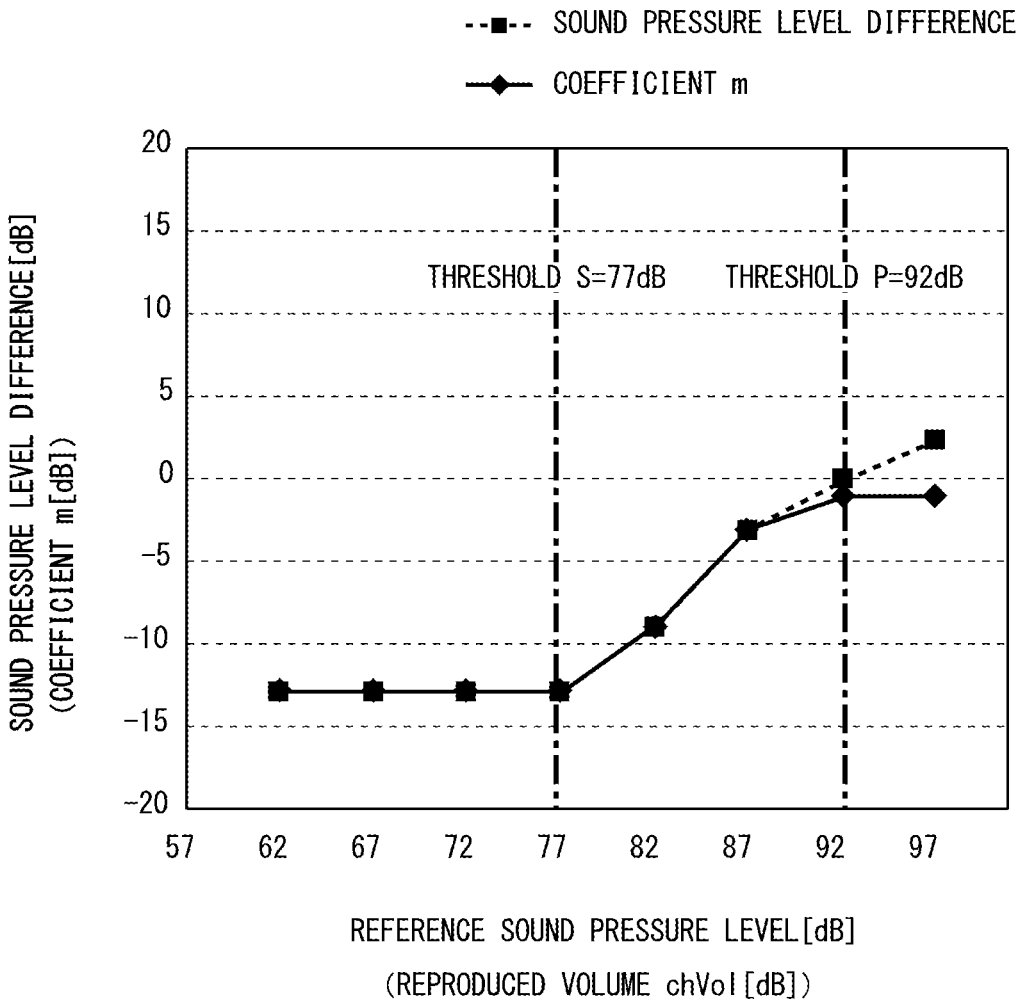
FIG. 12 is a graph showing a difference in sound pressure level between the phantom sound image in out-of-head localization headphones and the phantom sound image in stereo speakers in the graph of FIG. 10.
Figure 13:
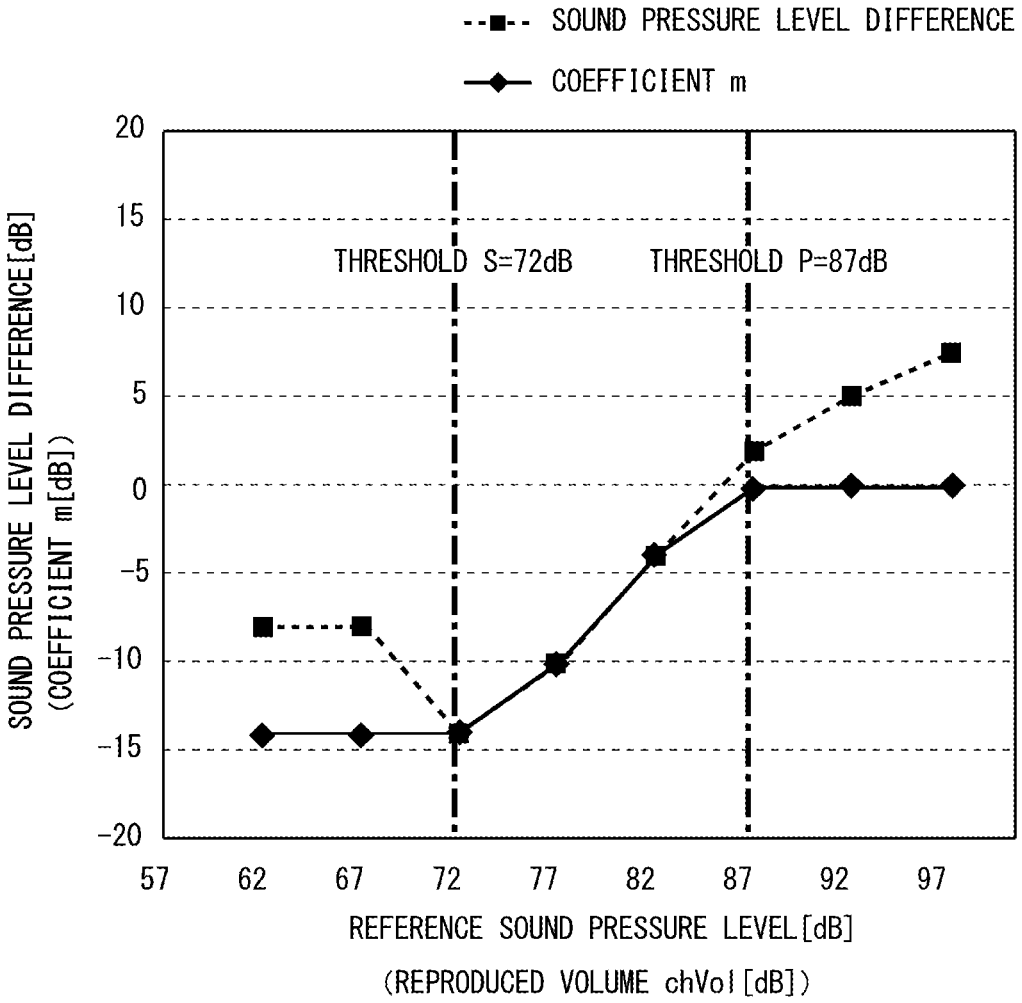
FIG. 13 is a graph showing a difference in sound pressure level between the phantom sound image in out-of-head localization headphones and the phantom sound image in stereo speakers in the graph of FIG. 11.

To describe a difference in the sound pressure level of the phantom sound images (a) to (c) in an auditory sense, FIGS. 12 and 13 show a difference of the at-the-ear sound pressure level of the (c) out-of-head localization headphone phantom sound image and the at-the-ear sound pressure level of the (a) stereo speaker phantom sound image (which is referred to as a sound pressure level difference Y). Note that the sound pressure level difference Y is a value obtained by subtracting the at-the-ear sound pressure level of the (a) stereo speaker phantom sound image from the at-the-ear sound pressure level of the (c) out-of-head localization headphone phantom sound image when the reference sound pressure level is the same. FIG. 12 indicates the sound pressure level difference Y in the graph of FIG. 10 by a broken line, and FIG. 13 shows the sound pressure level difference Y in the graph of FIG. 11 by a broken line. The horizontal axis indicates the reference sound pressure level [dB], and the vertical axis indicates the sound pressure level difference Y.

As shown in FIGS. 12 and 13, the reference sound pressure level at which the sound pressure level difference Y begins to increase is a threshold S. The reference sound pressure level at which the sound pressure level difference exceeds 0 [dB] is a threshold P. The threshold P is a greater value than the threshold S. Specifically, the reference sound pressure level at which the at-the-ear sound pressure level of the (c) out-of-head localization headphone phantom sound image is higher than the at-the-ear sound pressure level of the (a) stereo speaker phantom sound image is the threshold P. In FIG. 12, the threshold S is 77 [dB], and the threshold P is 92 [dB]. In FIG. 13, the threshold S is 72 [dB]m and the threshold P is 87 [dB]. The threshold S and the threshold P indicate different values depending on headphone type, such as open type and closed type.

The threshold P is the sound pressure level at which the at-the-ear sound pressure level of the (c) out-of-head localization headphone phantom sound image is substantially equal to the at-the-ear sound pressure level of the (a) stereo speaker phantom sound image. When the reproduced volume chVol is lower than the threshold P, the at-the-ear sound pressure level of the (c) out-of-head localization headphone phantom sound image is lower than the at-the-ear sound pressure level of the (a) stereo speaker phantom sound image. On the other hand, when the reproduced volume chVol is higher than the threshold P, the at-the-ear sound pressure level of the (c) out-of-head localization headphone phantom sound image is higher than the at-the-ear sound pressure level of the (a) stereo speaker phantom sound image.

Figure 14:
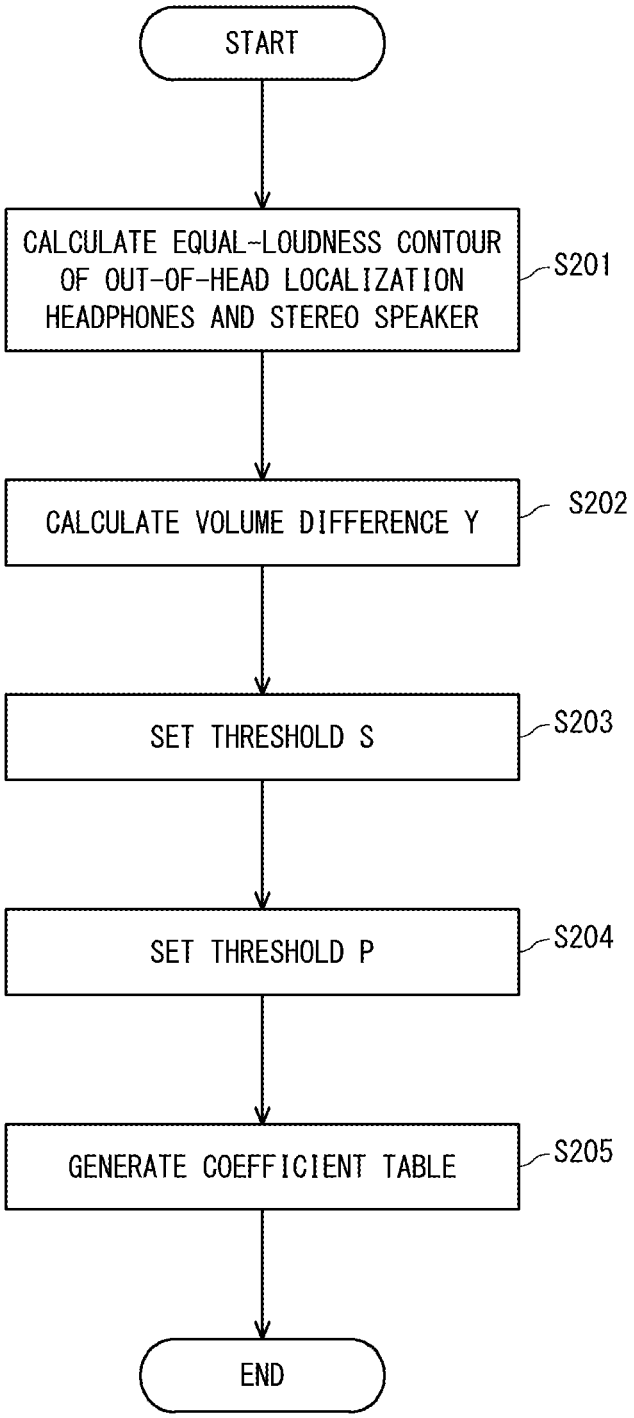
FIG. 14 is a flowchart showing a process of setting a coefficient table.

A coefficient m [dB] is set based on the threshold P and the threshold S. A method of setting the coefficient m [dB] is described hereinafter with reference to FIG. 14. FIG. 14 is a flowchart showing a method of setting the coefficient m [dB]. Note that each of the following processing may be performed by running a computer program. For example, a processor of the processing device 301 executes a computer program, and thereby the processing shown in FIG. 14 is performed. A user or a developer may perform a part or the whole of processing.

First, the processing device 301 calculates, with respect to the reference sound pressure level, the at-the-ear sound pressure level of the (c) out-of-head localization headphone phantom sound image and the at-the-ear sound pressure level of the (a) stereo speaker phantom sound image (S201). A developer conducts the testing in advance, and the graph of those sound pressure levels is prepared as the coefficient table. In this embodiment, the coefficient table calculated from the above testing is used.

The graph of each sound pressure level is preferably prepared for each headphone model. Further, the adjustment range of the reference sound pressure level is not particularly limited.

Next, the processing device 301 calculates the sound pressure level difference Y between the at-the-ear sound pressure level of the (c) out-of-head localization headphone phantom sound image and the at-the-ear sound pressure level of the (a) stereo speaker phantom sound image (S202). The processing device 301 then sets the threshold S based on the sound pressure level difference Y (S203). The threshold S is the reference sound pressure level at which the sound pressure level difference Y begins to increase.

Then, the processing device 301 sets the threshold P based on the sound pressure level difference Y (S204). The threshold P is a reference sound pressure level at which the sound pressure level difference Y exceeds 0 [dB]. When the sound pressure level difference Y does not exceed 0 [dB], the maximum value that does not exceed 0 [dB] may be set as the threshold P. In other words, the maximum value of the reference sound pressure level may be set as the threshold P. For example, in FIG. 13, the reference sound pressure level at which the sound pressure level difference Y exceeds 0 [dB] is 92 [dB] in the range where the reference sound pressure level is 62 [dB] to 97 [dB]. Therefore, 92 [dB] can be set as the threshold P.

After that, the processing device 301 generates the coefficient table of the coefficient m [dB] based on the threshold P and the threshold S (S205). The coefficient table is a table where the reproduced volume chVol during out-of-head localization (see FIG. 1) and the coefficient m [dB] are associated with each other. Thus, the reference sound pressure level, which is the horizontal axis in FIGS. 12 and 13, is replaced with the reproduced volume chVol during out-of-head localization processing. Specifically, the coefficient table is configured by replacing the reference sound pressure level in the horizontal axis with the reproduced volume chVol acquired by the volume acquisition unit 61.

In FIGS. 12 and 13, values of the coefficient m [dB] in the coefficient table are indicated by a solid line. When the reproduced volume chVol is lower than the threshold S, the coefficient m [dB] is the sound pressure level difference Y at the threshold S. Thus, when the reproduced volume chVol is lower than the threshold S, the coefficient m [dB] is fixed to the sound pressure level difference Y at the threshold S. When the reproduced volume chVol is equal to or higher than the threshold S and equal to or lower than the threshold P, the sound pressure level difference Y is used as the coefficient m [dB]. For example, the coefficient m [dB] increases as the reproduced volume chVol becomes higher. When the reproduced volume chVol is higher than the threshold P, the coefficient m [dB] is the maximum value. Note that, when the coefficient m [dB] is higher than the threshold P, the coefficient m [dB] is a fixed value less than 0 [dB].

Therefore, when the reproduced volume chVol is lower than the threshold S in the out-of-head localization process, the coefficient m [dB] is fixed at the minimum value. When the reproduced volume chVol is equal to or higher than the threshold S and equal to or lower than the threshold P, the coefficient m [dB] monotonically increases in accordance with an increase in the reproduced volume chVol. When the reproduced volume chVol is higher than the threshold P, the coefficient m [dB] is fixed at the maximum value. Note that, when the reproduced volume chVol is lower than the threshold S, the common-mode signal SrcIp to be subtracted is small, and there is no need to perform correction processing.

By calculating the coefficient table in this manner, it is possible to generate the corrected signals in consideration of a volume difference between actual headphones and speakers. Specifically, the subtraction ratio Amp1 is set to an appropriate value according to the reproduced volume. This enables appropriate subtraction of the common-mode signal from the stereo input signals. It is thereby possible to make an appropriate correction depending on a volume difference that varies according to the reproduced volume.

By adjusting the subtraction ratio of the common-mode component of headphone sound images, it is possible to suppress sound images localized at the phantom center from being emphasized by the binaural effect of the headphones. This prevents only phantom center sound images from coming closer even when the user U changes the volume and reproduces a sound field that equals a speaker sound field. The sound pressure level of phantom center sound images that changes by the binaural effect of headphones changes non-linearly depending on the reproduced volume chVol to be output.

As described above, the processing device 301 sets the threshold S and the threshold P based on the sound pressure level difference Y. Further, when the reproduced volume chVol is in the range of the threshold S to the threshold P, the coefficient m [dB] monotonically increases in accordance with the reproduced volume chVol. Because the component of the common-mode signal is smaller as the reproduced volume is higher, it is possible to appropriately reduce the significance of a change in the volume or the binaural effect of headphones.

Further, as shown in FIGS. 12 and 13, the threshold P and the threshold S are different depending on the type of headphones. It is thus preferable to set the threshold P and the threshold S for each headphone model and generate the coefficient table. Specifically, the sound pressure levels of the (a) stereo speaker phantom sound image and the (c) out-of-head localization headphone phantom sound image are obtained by conducting testing for each headphone model. Then, the sound pressure level difference Y is calculated based on the sound pressure levels at the ear, and the threshold S and the threshold P are set. Note that a part or the whole of setting of the threshold S and the threshold P and setting of the coefficient table may be performed by a user or a developer, or may be automatically performed by a computer program. There is no need to conduct testing for the (b) headphone-through phantom sound image.

MODIFIED EXAMPLE 1 OF SETTING OF COEFFICIENT M

Figure 15:
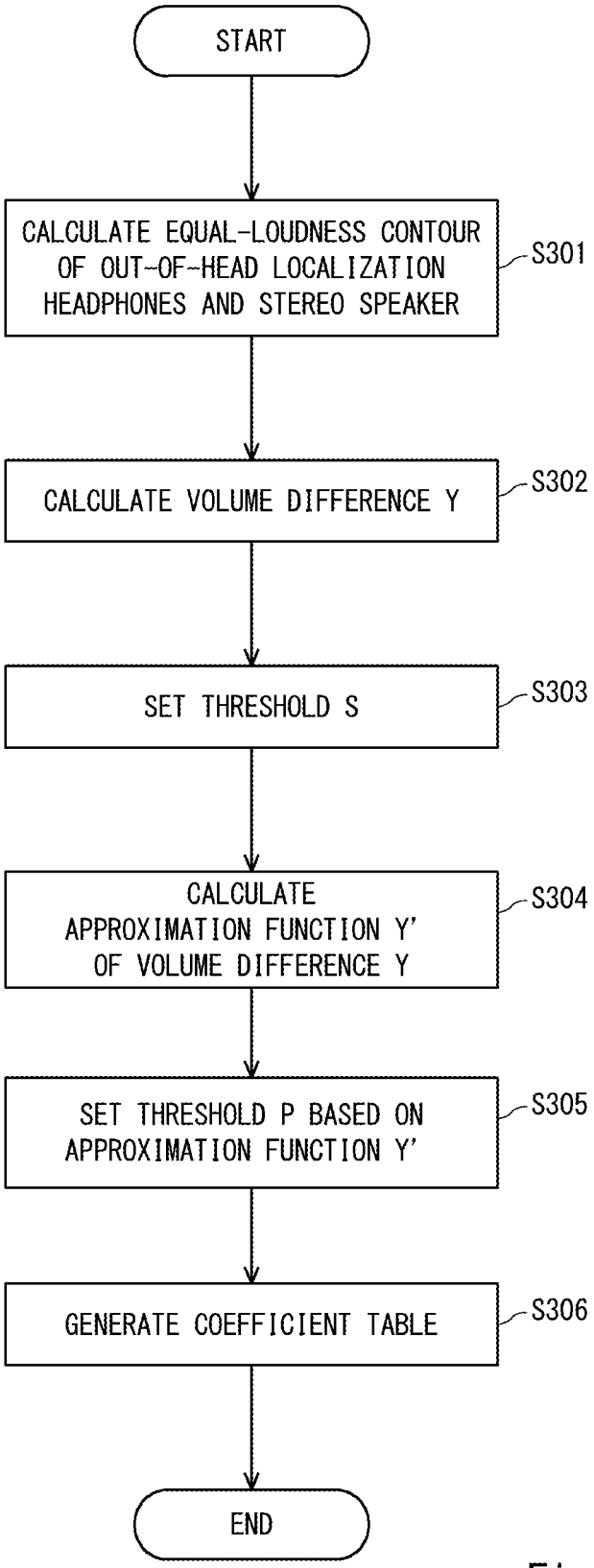
FIG. 15 is a flowchart showing a process of setting a coefficient m table according to a modified example.

Although the reference sound pressure level at which the sound pressure level difference Y is 0 [dB] is the threshold P in the above description, the threshold P is set in a different method in this modified example. To be specific, the threshold P is set by an approximation function Y' of the sound pressure level difference Y. FIG. 15 is a flowchart showing a process of setting the coefficient m [dB] when the threshold P is set by the method according to this modified example.

Note that the basic structure and processing of the out-of-head localization device are the same as those described above, and the detailed description thereof is omitted. Further, the (a) stereo speaker phantom sound images and the (c) out-of-head localization headphone phantom sound images are the same as those described above, and the detailed description thereof is omitted.

First, the processing device 301 calculates the at-the-ear sound pressure level of the (c) out-of-head localization headphone phantom sound image and the at-the-ear sound pressure level of the (a) stereo speaker phantom sound image (S301). Next, the processing device 301 calculates the sound pressure level difference Y between the (c) out-of-head localization headphone phantom sound image and the (a) stereo speaker phantom sound image (S302). The processing device 301 then sets the threshold S based on the sound pressure level difference Y (S303). The processing of S301 to S303 is the same as the processing of S201 to S203, and the detailed description thereof is omitted.

Figure 16:
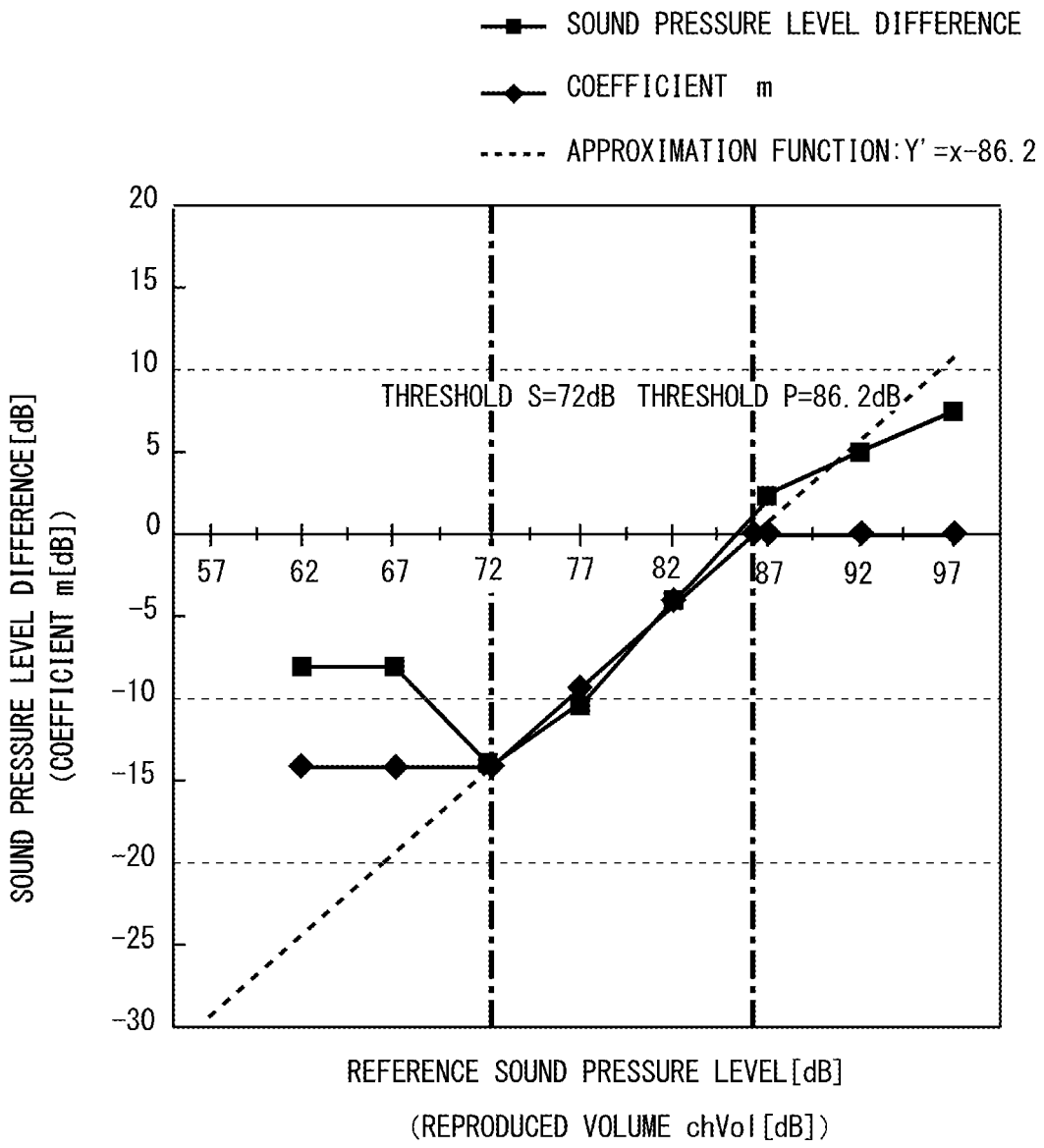
FIG. 16 is a graph showing an approximation function and a coefficient in the modified example.

Then, the processing device 301 calculates the approximation function Y' of the sound pressure level difference Y (S304). The approximation function Y' is calculated from the range where the reference sound pressure level is S or more. The approximation function Y' is calculated by linear approximation. FIG. 16 shows, by a broken line, the approximation function Y' in the case of the sound pressure level and the sound pressure level difference of out-of-head localization headphone phantom sound images in the closed headphones shown in FIGS. 11 and 13. In FIG. 16, linear approximation of Y'=x−86.2 is carried out.

Note that the approximation function Y' may be calculated by linear approximation or may be calculated by a quadratic or higher polynomial. Alternatively, the approximation function Y' may be calculated by a method of moving averages. The average coefficient m [dB] can be obtained by approximation.

The processing device 301 sets the threshold P based on the approximation function Y' (S305). Then, a value of the reference sound pressure level x at which a value of the approximation function Y' is 0 [dB] is set as the threshold P. In the graph shown in FIG. 16, Y'=0 at x=86.2 [dB], and therefore the threshold P=86.2 [dB].

Then, the processing device 301 generates the coefficient table based on the threshold S, the threshold P, and the approximation function Y' (S306). FIG. 16 also shows the coefficient table. When the reproduced volume chVol is lower than the threshold S, the coefficient m [dB] is the sound pressure level difference Y at the threshold S. Thus, when the reproduced volume chVol is lower than the threshold S, the coefficient m [dB] is fixed to the sound pressure level difference Y at the threshold S. Alternatively, when the reproduced volume chVol is lower than the threshold S, the correction unit 50 does not perform the correction processing.

When the reproduced volume chVol is equal to or higher than the threshold S and equal to or lower than the threshold P, the coefficient m [dB] is a value of the approximation function Y'. For example, the coefficient m [dB] increases as the reproduced volume chVol becomes higher. When the reproduced volume chVol is higher than the threshold P, the coefficient m [dB] is fixed to the maximum value of the approximation function Y'.

As described above, the same effects as in the first embodiment can be obtained even when the threshold P and the coefficient table are set. The out-of-head localization process can be thereby performed appropriately even when the volume is changed. It is thus possible to suppress sound images localized at the phantom center from being emphasized by a change in the volume or the binaural effect.

Second Embodiment

In a second embodiment, a coefficient m [%] directly indicating a ratio by % is set as the coefficient table, instead of the coefficient m [dB] indicating a ratio convert from decibels. Specifically, the coefficient m [%] directly indicating a ratio by % is associated with the reproduced volume chVol and set as the coefficient table. Thus, the coefficient m [%] matches Amp1 in the equations (2) and (3). Further, the coefficient m [%] is set according the user U's auditory sense when out-of-head localization reproduction is performed.

Figure 17:
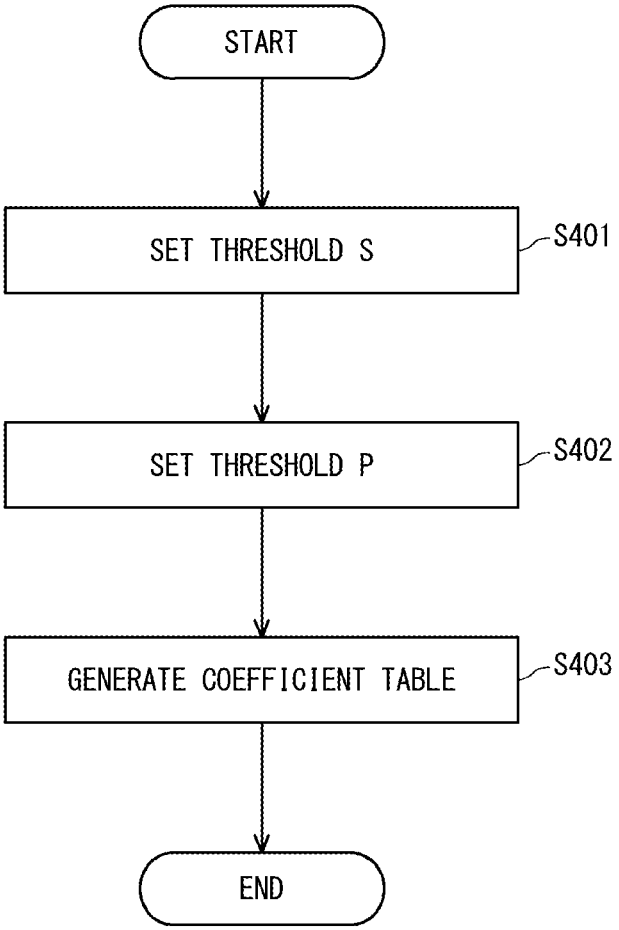
FIG. 17 is a view showing a process of setting a coefficient table according to a second embodiment.

A process of setting the coefficient table is described hereinafter with reference to FIG. 17. FIG. 17 shows a process of setting the coefficient table. First, the processing device 301 sets the threshold S (S401). In this step, the threshold S which is the minimum value in the control range is input based on an auditory sense when the user U wears the headphones 45 and listens to a signal on which out-of-head localization has been performed.

Next, the processing device 301 sets the threshold P (S402). In this step, like the processing in S401, the threshold P which is the maximum value in the control range is input based on an auditory sense when the user U wears the headphones 45 and listens to a signal on which out-of-head localization has been performed. For example, the threshold S may be 72 [dB], and the threshold P may be 87 [dB]. Then, the threshold S and the threshold P are stored in a memory or the like. The threshold S and the threshold P may be set according to user input.

Figure 18:
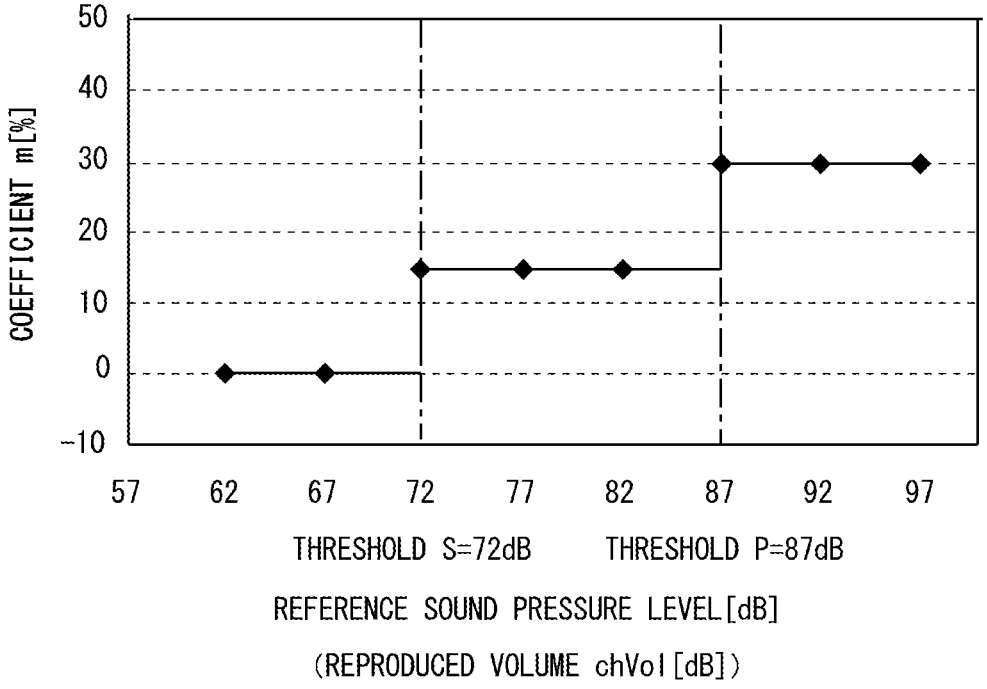
FIG. 18 is a graph illustrating the coefficient table in the second embodiment.

Then, the processing device 301 generates the coefficient table based on the threshold S and the threshold P (S403). The coefficient table is described with reference to FIG. 18. The coefficient m [%] is set in three stages based on the threshold S and the threshold P. For example, at the reproduced volume chVol lower than the threshold S, the coefficient m [%] is 0 [%]. At the reproduced volume chVol equal to or higher than the threshold S and lower than the threshold P, the coefficient m [%] is 15 [%]. At the reproduced volume chVol equal to or higher than the threshold P, the coefficient m [%] is 30 [%].

As described above, the coefficient table is set in such a way that the coefficient m [%] increases in stages in accordance with an increase in the reproduced volume chVol. As a matter of course, the value of the coefficient m [%] may increase in four or more stages, not limited to three stages. A plurality of values of the coefficient m [%] may be set in a range from the threshold S to the threshold P. The coefficient m [%] is set in the range more than 0% and less than 100%.

Note that, in the case of using the coefficient table containing Amp1=coefficient m/100[%], the corrected signals are calculated based on the following equations (9) and (10), instead of the equations (6) and (7).

$$SrcL'=SrcL-SrcIp*m/100 \quad (9)$$

$$SrcR'=SrcR-SrcIp*m/100 \quad (10)$$

In this embodiment, a method of out-of-head localization is the same as that described in the first embodiment, and the detailed description thereof is omitted. For example, the out-of-head localization process can be performed according to the flowchart shown in FIG. 8. Then, the coefficient m [%] is set instead of the coefficient m [dB] in the step S104 of setting a coefficient. Further, in the step S106 of subtracting the common-mode signal from the stereo input signals, the above-described equations (9) and (10) are used instead of the equations (6) and (7).

MODIFIED EXAMPLE 2

Although the coefficient m in accordance with the reproduced volume chVol is set by referring to the coefficient table in the second embodiment, the coefficient m is set by the user U according to an auditory sense in a modified example 2. For example, the user U may change the subtraction ratio of the common-mode component according to an auditory sense while listening to stereo reproduced signals on which out-of-head localization has been performed.

For example, when the user U feels that vocal sound images localized at the phantom center generated from out-of-head localization headphones are too close, the user U performs input for increasing the coefficient [%]. For example, the user U operates a touch panel to perform user input. When the user input is received, the out-of-head localization device 100 increases the coefficient m [%]. For example, when the user U feels that phantom center sound images are too close, the user U performs an operation to increase the coefficient m [%]. On the other hand, when the user U feels that phantom center sound images are too far, the user U performs an operation to decrease the coefficient m [%]. In the modified example 2 also, the coefficient m [%] may increase and decrease in stages like 0[%], 15[%], 30[%] and the like.

Further, setting of the coefficient by user input and setting of the coefficient depending on the reproduced volume may be combined. For example, the out-of-head localization device 100 performs out-of-head localization at the coefficient depending on the reproduced volume. Then, the user may perform an operation to change the coefficient depending on an auditory sense when the user listens to reproduced signals after the out-of-head localization. Further, the coefficient m may be changed when the user performs an operation to change the reproduced volume.

Note that, when the coefficient m [dB] exceeds −6 [dB] (i.e., m[%]=50%), an auditory sense is such that the left and right balance is disrupted in some cases. Therefore, −6 [dB] may be set as the upper limit of the coefficient m [dB], and a value of −6 [dB] or less may be set to the coefficient table.

The coefficient calculated from an equal-loudness contour is an ideal value, and the left and right volume balance can be disrupted depending on a set value of the coefficient m. Thus, the value may be adjusted to be smaller than the ideal value in accordance with actual music. An algorithm for extracting the common-mode signal is an example, and it is not limited thereto. For example, the common-mode signal may be extracted using an adaptation algorithm.

A part or the whole of the above-described out-of-head localization processing and measurement processing may be executed by a computer program. The above-described program can be stored and provided to the computer using any type of non-transitory computer readable medium. The non-transitory computer readable medium includes any type of tangible storage medium. Examples of the non-transitory computer readable medium include magnetic storage media (such as floppy disks, magnetic tapes, hard disk drives, etc.), optical magnetic storage media (e.g. magneto-optical disks), CD-ROM (Read Only Memory), CD-R , CD-R/W, DVD-ROM (Digital Versatile Disc Read Only Memory), DVD-R (DVD Recordable)), DVD-R DL (DVD-R Dual Layer)), DVD-RW (DVD ReWritable)), DVD-RAM), DVD+R), DVR+R DL), DVD+RW), BD-R (Blu-ray (registered trademark) Disc Recordable)), BD-RE (Blu-ray (registered trademark) Disc Rewritable)), BD-ROM), and semiconductor memories (such as mask ROM, PROM (Programmable ROM), EPROM (Erasable PROM), flash ROM, RAM (Random Access Memory), etc.). The program may be provided to a computer using any type of transitory computer readable medium. Examples of the transitory computer readable medium include electric signals, optical signals, and electromagnetic waves. The transitory computer readable medium can provide the program to a computer via a wired communication line such as an electric wire or optical fiber or a wireless communication line.

Although embodiments of the invention made by the present invention are described in the foregoing, the present invention is not restricted to the above-described embodiments, and various changes and modifications may be made without departing from the scope of the invention.

The present application is applicable to an out-of-head localization device that localizes sound images by headphones or earphones outside the head.

What is claimed is:

1. An out-of-head localization device comprising:

a common-mode signal calculation unit configured to calculate a common-mode signal of stereo reproduced signals;

a ratio setting unit configured to set a subtraction ratio for subtracting the common-mode signal;

a subtraction unit configured to subtract the common-mode signal from the stereo reproduced signals at the subtraction ratio and thereby generate corrected signals;

a convolution calculation unit configured to perform convolution on the corrected signals by using spatial acoustic transfer characteristics and thereby generate a convolution calculation signal;

a filter unit configured to perform filtering on the convolution calculation signal by using a filter and thereby generate an output signal; and an output unit configured to include headphones or earphones and output the output signal to a user.

2. The out-of-head localization device according to claim 1, wherein the ratio setting unit changes the subtraction ratio in accordance with a reproduced volume.

3. The out-of-head localization device according to claim 2, wherein when the reproduced volume is within a specified range, the subtraction ratio monotonically increases in accordance with an increase in the reproduced volume.

4. The out-of-head localization device according to claim 2, wherein the subtraction ratio increases in stages in accordance with an increase in the reproduced volume.

5. The out-of-head localization device according to claim 2, wherein when the reproduced volume is low, the subtraction unit does not perform subtraction, and the convolution calculation unit performs convolution on the stereo reproduced signals as the corrected signals.

6. The out-of-head localization device according to claim 1, wherein the ratio setting unit changes the subtraction ratio in response to user input.

7. The out-of-head localization device according to claim 1, wherein when a correlation of the stereo reproduced signals meets specified conditions, the subtraction unit performs subtraction, and when a correlation of the stereo reproduced signals does not meet specified conditions, the subtraction unit does not perform subtraction, and the convolution calculation unit performs convolution on the stereo reproduced signals as the corrected signals.

8. An out-of-head localization method comprising:

a step of calculating a common-mode signal of stereo reproduced signals;

a step of setting a subtraction ratio for subtracting the common-mode signal;

a step of subtracting the common-mode signal from the stereo reproduced signals at the subtraction ratio and thereby generating corrected signals;

a step of performing convolution on the corrected signals by using spatial acoustic transfer characteristics and thereby generating a convolution calculation signal;

a step of performing filtering on the convolution calculation signal by using a filter and thereby generating an output signal; and a step of outputting the output signal to a user through headphones or earphones.

9. A non-transitory computer readable medium storing an out-of-head localization program causing a computer to execute:

a step of calculating a common-mode signal of stereo reproduced signals;

a step of setting a subtraction ratio for subtracting the common-mode signal;

a step of subtracting the common-mode signal from the stereo reproduced signals at the subtraction ratio and thereby generating corrected signals;

a step of performing convolution on the corrected signals by using spatial acoustic transfer characteristics and thereby generating a convolution calculation signal;

a step of performing filtering on the convolution calculation signal by using a filter and thereby generating an output signal; and a step of outputting the output signal to a user through headphones or earphones.

* * * * *